US005518871A

United States Patent [19]

Urabe

[11] Patent Number: 5,518,871

[45] Date of Patent: May 21, 1996

[54] PHOTOGRAPHIC MATERIAL CONTAINING SILVER HALIDE GRAINS DOPED WITH HEXA-COORDINATED CYANO-COMPLEX

[75] Inventor: Shigeharu Urabe, Kanagawa, Japan

[73] Assignee: Fuji Photo Film Co., Ltd., Kanagawa, Japan

[21] Appl. No.: 292,973

[22] Filed: Aug. 22, 1994

Related U.S. Application Data

[63] Continuation-in-part of Ser. No. 201,379, Feb. 24, 1994, abandoned.

[30] Foreign Application Priority Data

Feb. 24, 1993 [JP] Japan ..... 5-035605

[51] Int. Cl.[6] ..... G03C 1/09

[52] U.S. Cl. ..... 430/567; 430/569; 430/599; 430/604; 430/605; 430/606

[58] Field of Search ..... 430/567, 569, 430/599, 604, 605, 606

[56] References Cited

U.S. PATENT DOCUMENTS

| | | | |
|---|---|---|---|
| 4,269,927 | 5/1981 | Atwell | 430/605 |
| 4,395,478 | 7/1983 | Hoyen | 430/605 |
| 4,937,180 | 6/1990 | Marchetti et al. | 430/605 |
| 4,945,035 | 7/1990 | Keevert, Jr. et al. | 430/605 |
| 4,981,780 | 1/1991 | Inoue et al. | 430/604 |
| 5,132,203 | 7/1992 | Bell et al. | 430/605 |
| 5,204,234 | 4/1993 | Asami | 430/604 |
| 5,213,953 | 5/1993 | Yamamoto | 430/605 |
| 5,264,336 | 11/1993 | Marchetti et al. | 430/605 |
| 5,268,264 | 12/1993 | Marchetti et al. | 430/605 |
| 5,348,848 | 9/1994 | Murakami et al. | 430/569 |

*Primary Examiner*—Mark F. Huff
*Attorney, Agent, or Firm*—Birch, Stewart, Kolasch & Birch

[57] ABSTRACT

A silver halide photographic material comprises a support and a light-sensitive layer provided thereon. The light-sensitive layer contains silver halide grains dispersed in gelatin. A hexa-coordinated cyano-complex is doped in the silver halide grains. The amount of the complex is in the range of $1\times10^{-7}$ to $5\times10^{-3}$ mol based on 1 mol of silver halide. A localized phase of the complex is present on the surface of the grains. The localized phase contains the complex in an amount of $1\times10^{-5}$ to $1\times10^{-1}$ mol based on 1 mol of silver halide. According to the present invention, the silver halide grains are doped in the presence of a compound having a function of inhibiting a reaction of the cyano-complex with gelatin, or the compound having the function is added to the grains after the grains are doped.

27 Claims, No Drawings

PHOTOGRAPHIC MATERIAL CONTAINING SILVER HALIDE GRAINS DOPED WITH HEXA-COORDINATED CYANO-COMPLEX

CROSS-REFERENCE TO RELATED APPLICATION

This is a continuation-in-part application of U.S. patent application Ser. No. 08/201,379 filed on Feb. 4, 1994, now abandoned.

FIELD OF THE INVENTION

The present invention relates to a silver halide photographic material containing silver halide grains doped with a hexa-coordinated cyano-complex.

BACKGROUND OF THE INVENTION

In preparation of a silver halide emulsion, a dopant (i.e., substances other than silver and halogen ion) is sometimes introduced into silver halide crystals, which has been well known as a doping technique. The doping technique of a transition metal has particularly been studied to improve a silver halide emulsion. For example, a transition metal compound of VIII group having a cyano has sometimes been added to a silver halide emulsion in formation of silver halide grains to improve the sensitivity of the emulsion.

Japanese Patent Publication No. 48(1973)-35373 discloses a process of forming silver halide grains in the presence of a water-soluble iron compound, which is used in an amount of $10^{-7}$ to $10^{-3}$ mol based on 1 mol of silver. The publication describes that an emulsion of hard gradation can be prepared according to the process without degrading the sensitivity.

Japanese Patent Publication No. 49(1974)-14265 discloses an emulsion containing silver halide grains having a particle size of not larger than 0.9 μm. A metal compound of group VIII in an amount of $10^{-6}$ to $10^{-3}$ mol based on 1 mol of silver is added to the emulsion in formation of the grains, and the emulsion was spectrally sensitized with a merocyanine dye.

According to the process of the above-mentioned publications, an emulsion of high sensitivity can be obtained. However, a relative increase of the surface sensitivity is small, since the internal sensitivity as well as the surface sensitivity is increased in the obtained silver halide grains.

Japanese Patent Provisional Publication No. 1(1989)-21844 discloses a high sensitive silver halide emulsion containing silver halide grains that have at least two parts. The halogen compositions of the two parts are different from each other. The part that has the smallest band gap energy contains divalent iron ion. The effect of this technique is limited to the emulsion containing divalent iron ion. The publication is silent with respect to the ligand of the ion.

A transition metal compound can be added to the silver halide emulsion at the stage of grain formation. The compound may also be added to the emulsion after precipitation of silver halide grains. However, there is a considerable difference in a photographic effect between the former addition and the latter addition. In the former addition, the transition metal of the compound is introduced into the silver halide crystal as a dopant. Therefore, the transition metal can effectively change the photographic properties of the emulsion, even if a small amount of the compound is used. On the other hand, the transition metal is adsorbed on the surface of the silver halide grains in the latter addition.

In this case, a relatively large amount of the transition metal compound is required to change the photographic properties of the emulsion to the same extent as the former addition. The function of the transition metal to the silver halide grains is inhibited by a protective colloid at the former addition. Accordingly, it is difficult to obtain a satisfactory photographic effect, if the transition metal is added to the emulsion at the stage of chemical sensitization. Therefore, the transition metal has been usually added as a dopant to the emulsion at the stage of silver halide grain formation. As is described above, metal doping (the former addition) is different from metal sensitization (the latter addition).

The chapter IA of Research Disclosure No. 17,643 discloses transition metal compounds, which may be added to the emulsion at the stage of precipitation of silver halide grains. On the other hand, the chapter IIIA discloses transition metal compounds, which may be added to the emulsion added during chemical sensitization.

U.S. Pat. No. 4,126,472 discloses use of iridium as a dopant attached to the surface of silver halide grain or as a surface modifier for silver halide. According to the description of the patent, silver halide emulsion is sensitized in the presence of a water-soluble iridium salt. The amount of the salt is $10^{-6}$ to $10^{-4}$ mol based on 1 mol of silver halide. However, U.S. Pat. No. 4,126,472 is silent with respect to hexa-coordinated cyano-complex.

European Patent No. 0,242,190 describes that silver halide emulsion containing grains formed in the presence of a complex of trivalent rhodium having three, four, five or six cyano ligands. In the emulsion described in the publication, low intensity reciprocity law failure is reduced.

U.S. Pat. No. 3,690,888 discloses a process for preparing silver halide containing multivalent metal ions. In the process, silver halide is formed in the presence of protective colloid mainly comprising acrylic polymer. U.S. Pat. No. 3,690,888 further describes that the multivalent metal ions include bismuth, iridium, lead and osmium. However, U.S. Pat. No. 3,690,888 is silent with respect to hexa-coordinated cyano complex.

The above-mentioned publications do not disclose that the ligands are introduced into a grain together with the transition metal. Further, they are silent with respect to regulation of the ligand and the effect of the transition metal complex.

European Patents No. 0,336,190 and No. 0,336,426 and Japanese Patent Provisional Publications No. 2(1990)-20853 and No. 2(1990)-20854 disclose silver halide emulsions having excellent characteristics. The emulsions can be obtained by using hexa-coordinated complex of rhenium, ruthenium, osmium or iridium having at least four cyano ligands. In the emulsions described in these publications, low intensity reciprocity law failure is reduced, and the sensitivity and gradation of the emulsion are stable.

Each of European Patent No. 0,336,427 and Japanese Patent Provisional Publication No. 2(1990)-20852 discloses a silver halide emulsion of a controlled sensitivity. In the emulsion, low intensity reciprocity law failure is reduced without decreasing the sensitivity of a middle intensity by using a hexa-coordinated complex of vanadium, chromium, manganese, iron, ruthenium, osmium, rhenium or iridium having nitrosyl or thionitrosyl ligand.

Each of European Patent No. 0,336,689 and Japanese Patent Provisional Publication No. 2(1990)-20855 also discloses a silver halide emulsion of a controlled sensitivity. In the emulsion, low intensity reciprocity law failure is reduced by hexa-coordinated rhenium complex. The complex has six ligands selected from halogen, nitrosyl, thionitrosyl, cyano, water and thiocyan.

Japanese Patent Provisional Publication No. 3(1991)-118535 discloses a hexa-coordinated transition metal complex having carbonyl group as one of the ligands. Further, Japanese Patent Provisional Publication No. 3(1991)-118536 discloses an emulsion containing a hexa-coordinated transition metal complex in which two of the ligands are oxygen atoms.

U.S. Pat. No. 5,132,203 discloses high sensitive tabular grains, which contains a hexa-coordinated complex of a metal of VIII group having at least four cyano ligands in the subsurface. The surface of the grain (20 to 350 Å) does not contain the complex. European Patent No. 0,508,910 discloses a silver halide emulsion, wherein the subsurface of the silver halide grain is doped with a hexa-coordinated iron complex. The surface of the grain (20 to 350 Å) is not doped with the iron complex. These patents suggest that the hexa-coordinated cyano complex is doped near the surface of the grain to obtain a high sensitivity, but the complex is not preferably present in the surface. Accordingly, they teach that the subsurface of the grain is doped with the hexa-coordinated metal cyano-complex and they are silent with respect to the surface doping of the complex.

SUMMARY OF THE INVENTION

U.S. Pat. No. 5,132,203 and European Patent No. 0,508,910 employ a subsurface doping to reduce the amount of a hexa-coordinated cyano-complex contained in the surface of the grains and the medium of the silver halide emulsion. However, the present inventor has noted that the hexa-coordinated cyano-complex is preferably present in the surface of the grains to obtain the maximum sensitizing effect.

Accordingly, the inventor has studied a silver halide photographic material wherein the surface of the grain is doped with a hexa-coordinated cyano-complex. As a result, the inventor notes a phenomenon that a cyanide is formed when the surface of the grain is doped with the cyano-complex. The cyanide is well adsorbed on the surface of the grain. It is difficult to remove the cyanide even by washing the formed grains with water because the ion is fixed on the surface. Accordingly, the cyanide remains on the surface of the grain after the washing process.

A silver halide emulsion is usually subject to a chemical sensitization to obtain a high sensitivity. A gold sensitization is a representative chemical sensitization. The gold sensitization is frequently used in preparation of a silver halide emulsion Gold ($Au^{3+}$, $Au^{1+}$ or Au) contained in the gold sensitization is adsorbed on the surface of silver halide grain to form a sensitivity speck (sensitized nucleus). When a cyanide is adsorbed on the surface, the gold ion reacts with the cyanide to form a stable gold cyano-complex, which moves in the medium of the emulsion and present in the stable state. As a result, the gold ion cannot be adsorbed on the surface of the grain. Therefore, the effect of the gold sensitization is greatly reduced by the cyanide.

An object of the present invention is to obtain a full effect of a hexa-coordinated cyano-complex.

Another object of the invention is to inhibit a reaction of the hexa-coordinated cyano-complex with gelatin when the surface of the silver halide grain is doped with the complex.

A further object of the invention is to provide a silver halide photographic material improved in the high sensitivity, the hard gradation, the resistance to pressure and the preservability.

The present invention provides a silver halide photographic material which comprises a support and a light-sensitive layer provided thereon, said light-sensitive layer containing silver halide grains dispersed in gelatin, wherein a hexa-coordinated cyano-complex is doped in the silver halide grains under conditions that the amount of the complex is in the range of $1\times10^{-7}$ to $5\times10^{-3}$ mol based on 1 mol of silver halide and a localized phase of the complex is present in the surface of the grains, said localized phase containing the complex in an amount of $1\times10^{-5}$ to $1\times10^{-1}$ mol based on 1 mol of silver halide, and said complex being a salt containing a hexa-coordinated transition metal complex anion represented by the formula (I):

$$[M(CN)_6]^{n-} \quad (I)$$

wherein M is a transition metal selected from those consisting of metals of the VA, VIA, VIIA and VIII groups of the fourth, fifth and sixth periods in the periodic table, and n is 3 or 4, and wherein a compound having a function of inhibiting a reaction of the cyano-complex with gelatin is added to the grains after the silver halide grains are doped.

The invention also provides a silver halide photographic material which comprises a support and a light-sensitive layer provided thereon, said light-sensitive layer containing silver halide grains dispersed in gelatin, wherein a hexa-coordinated cyano-complex is doped in the silver halide grains under conditions that the amount of the complex is in the range of $1\times10^{-7}$ to $5\times10^{-3}$ mol based on 1 mol of silver halide and a localized phase of the complex is present in the surface of the grains, said localized phase containing the complex in an amount of $1\times10^{-5}$ to $1\times10^{-1}$ mol based on 1 mol of silver halide, and said complex being a salt containing a hexa-coordinated transition metal complex anion represented by the above-mentioned formula (I), and wherein the silver halide grains are doped in the presence of a compound having a function of inhibiting a reaction of the cyano-complex with gelatin, said compound being used in an amount of $4\times10^{-3}$ to 1 mol based on 1 mol of silver halide.

The present inventor has found that a cyanide is formed by a reaction of gelatin with a hexa-coordinated cyano-complex. The complex is present in the surface of the grains or in the gelatin medium.

The prior art references disclose the doping of a metal complex in silver halide grains. However, gelatin is always used as a protective colloid in formation of the grains. A reaction of a metal with gelatin is described in T. H. James, The Theory of the Photographic Process (fourth edition), Chapter 2 (pages 71 to 72). According to the description, a noble metal (e.g., gold, platinum) or a heavy metal (e.g., iridium) reacts with gelatin to form a complex or to reduce another metal. However, the prior art disregards oxidation or reduction of a transition metal complex caused by the reaction of a metal complex with gelatin. The prior art also disregards exchange of ligands contained in transition metal complexes and decomposition of the complexes. Accordingly, the prior art references are completely silent with respect to the means of controlling the reaction of the transition metal complex with gelatin.

According to the inventions of the above-mentioned U.S. Pat. No. 5,132,203 and European Patent No. 0,508,910, the hexa-coordinated cyano-complex is not present in the surface of the silver halide grains. When the hexa-coordinated cyano-complex is incorporated into the internal (or subsurface) part of the grains, the complex scarcely reacts with gelatin. Accordingly, formation of cyanide is not remarkable in these inventions. On the other hand, the formation of cyanide is remarkable when the surface of the grain is doped with the hexa-coordinated cyano-complex to obtain the maximum effect of the doped cyano-complex.

The present invention uses a compound having a function of inhibiting a reaction of the cyano-complex with gelatin. The compound can inhibit the formation of the cyanide. Accordingly, the present invention now solves the worst problem when the surface of the silver halide grain is doped with the hexa-coordinated cyano-complex, namely the formation of the cyanide. Therefore, a full effect of the doped hexa-coordinated cyano-complex can be obtained according to the present invention. Further, the maximum effect of the gold sensitization can also be obtained according to the invention.

For the reasons mentioned above, the present invention provides a silver halide photographic material improved in the high sensitivity, the hard gradation, the resistance to pressure and the preservability.

DETAILED DESCRIPTION OF THE INVENTION

The hexa-coordinated cyano complex salt used for the invention is a salt containing a hexa-coordinated transition metal complex anion represented by the formula (I):

$$[M(CN)_6]^{n-} \quad (I)$$

wherein M is a metal selected from those consisting of the metals of VA, VIA, VIIA and VIII groups of the fourth, fifth and sixth periods in the periodic table; preferably, M is iron, cobalt, ruthenium, rhenium, rhodium, osmium or iridium; and n is 3 or 4.

Most of the hexa-coordinated metal complex salts dissociate when they are added into aqueous solvents, which are generally used for forming silver halide grains. Therefore, the counter cation is not important. However, ammonium and alkali metal ions are very advantageous for precipitation process of silver halide. Therefore, ammonium and alkali metal ions are particularly preferable as a counter ion of the hexa-coordinated transition metal complex salt.

In the present invention, the amount of the hexa-coordinated cyano-complex incorporated into the silver halide grains is in the range of $1\times10^{-7}$ to $5\times10^{-3}$ mol based on 1 mol of silver halide. Further, a localized phase of the complex is present in a surface part of the grains. The amount of the complex contained in the localized phase is more than 10 times as large as the amount of the complex contained in the other phase. The amount of the surface part is not more than 50% of each of the grains. The localized phase preferably contains the complex in an amount of $1\times10^{-5}$ to $1\times10^{-1}$ mol based on 1 mol of silver halide. In the present specification, the term "surface part" means not only a continuous layered shell part of a core/shell structure but also discontinuous junction (contact) part of a junction (contact) structure. The silver halide grains having the junction (contact) structures are described in Japanese Patent Provisional Publications No. 59(1984)-133540, No. 58(1983)-108526, No. 59(1984)-16254, Japanese Patent Publication No. 58(1983)-24772 and European Patent Publication No. 199290A2.

The hexa-coordinated metal cyano-complex incorporated (doped) into the silver halide grains forms a shallow electron trap in the grains. When the grains absorb light to form a pair of a positive hole and an electron, the electron can freely move in crystals of the grains. In silver halide grains doped with a hexa-coordinated cyano-complex, a photoelectron is temporarily captured in a shallow trap. According to the present invention, many shallow traps are formed in the grain. Accordingly, an electron escaped from a shallow trap is often captured again in another trap. Therefore, a photoelectron can remain for a relatively long time while going in and out the shallow traps. Thus, the possibility of formation of silver speck (i.e., latent image) can be increased in the present invention. The electrons for formation of latent image are stored in the grains to increase the sensitivity of the emulsion. The shallow electron trap reduces the moving distance of an electron, while a deep trap captures the electron permanently. Accordingly, the shallow trap must be distinguished from the deep trap. It has been known that silver ion contained in a crystal structure of silver halide may be replaced with iridium atom to form a deep trap.

The concentration of the hexa-coordinated cyano-complex in the surface part of the silver halide grains is preferably higher than that in the internal part of the grains. The amount of the surface part of the high concentration is not more than 50%, preferably not more than 30 and more preferably 20% of each of the grains. The localized phase contains the complex in an amount of $1\times10^{-5}$ to $1\times10^{-1}$ mol, and preferably $1\times10^{-4}$ to $1\times10^{-2}$ mol based on 1 mol of silver halide. The hexa-coordinated cyano-complex forms a shallow electron trap in the grains to capture an electron formed by exposure. If the complex is present in an internal part of the grains, a latent image is often formed in the internal part. Accordingly, the complex is preferably present in the surface part to form a latent image on the surface of the grains. The localized phase may continuously form a layer on the surface of the grains.

Most of the silver halide emulsions except a specific internal latent image emulsion (e.g., direct positive emulsion) should form a latent image on the surface of the silver halide grains. Accordingly, the complex used in the present invention is preferably present on the surface of the grains to obtain a high sensitivity.

The amount or the ratio of the hexa-coordinated cyano complex doped in silver halide can be measured according to various analysis methods. Examples of the methods include atomic absorption analysis of the central transition metal, ICP (inductively coupled plasma spectrometry) analysis and ICPMS (inductively coupled plasma mass spectrometry) analysis.

The stability of the hexa-coordinated cyano complex should be considered to use it in a photographic material. It has been known that the complex is decomposed at an extremely low pH to form cyanogen by a reaction of exchanging cyano. Though the pH value of the decomposition depends of the nature of the complex, the value is usually lower than the pH condition in formation of silver halide grains of an emulsion. According to study of the present inventor, the reaction proceeds at an extremely low pH when the complex is contained in only water. However, the decomposition reaction may proceed at a relatively high pH (e.g., 5.0 to 7.0) in the presence of gelatin to form cyanogen. Even if gelatin is present, cyanogen is scarcely formed at a pH value of higher than 7.0. As is described above, formation of cyanogen is remarkable at a low pH value. In the presence of gelatin, the reaction proceeds at a pH condition in preparation of a silver halide emulsion.

The hexa-coordinated cyano-complex salt of the invention is preferably dissolved in water or an appropriate solvent to prepare a solution for addition. An aqueous solution of a halide salt of an alkali metal (e.g., KCl, NaCl, KBr, NaBr) can be mixed with the solution to stabilize the complex. An alkali can also be added to the solution, if desired.

The hexa-coordinated cyano complex salt of the invention is preferably added into a reaction solution directly while forming the silver halide. The complex salt can also be added into an aqueous solution of halogen salt or other solutions, which may be added into the reaction solution for forming the silver halide grains. Thus, the complex can be introduced into the silver halide grains. The other methods for addition of the complex can be used in combination.

All or a part of the nuclear formation or crystal growth of silver halide can be conducted by supplying a silver halide emulsion of fine silver halide grains. The fine silver halide grains are described in Japanese Patent Provisional Publications No. 1(1989)-183417, No. 1(1989)-83644, No. 1(1989)-183645, No. 2(1990)-43534, No. 2(1990)-3535, No. 2(1990)-44335, U.S. Pat. No. 4,879,208 and European Patent No. 0,408,752. A hexa-cyano complex salt can be doped in fine silver halide grains.

Two or more hexa-coordinated cyano-complex salts can be used in combination. The complex can also be used in combination with other metal ions. Such other metal ions can be used in the form of salts, such as ammonium salt, acetate salt, nitrate salt, sulfate salt, phosphate salt, hydroxide salt, hexa-coordinated complex salt and tetra-coordinate complex salt. The salt should be dissolved in the reaction solution while forming the silver halide grains.

Cyanogen may be formed when the hexa-coordinated cyano-complex is incorporated into silver halide grains. Cyanogen may also be formed at a post-treatment step where a hexa-coordinated cyano-complex is present in the surface of the grains. Examples of the post-treatment steps include washing step, dispersing step, chemically sensitizing step and dissolving step after formation of grains and before coating of emulsion. The cyanogen is formed by a reaction of the complex with gelatin.

According to the present invention, the doping step or the post-treatment step (preferably both of the steps) is conducted in the presence of a compound that has a function of inhibiting a reaction of the cyano-complex with gelatin.

The compound having the inhibiting function can easily be found, for example according to the following experiments (1) to (5). The present invention preferably uses a compound showing an absorbance of not higher than 0.4 at the experiment (5).

(1) Bovine bone gelatin (preferably obtained from slaughterhouse) is lime-treated and deionized. The calcium content of the gelatin is not more than 50 ppm. The isoelectric point of the gelatin is in the range of 5.0±0.05. At 40° to 45° C. 50 cc of 6% aqueous solution of the gelatin is prepared using distilled water. The pH of the solution is analogous to the isoelectric point.

(2) A sample solution of a test compound (or a salt thereof) is added to the gelatin solution, and the mixture is adjusted to pH of 5.0±0.05.

(3) The gelatin solution is heated to 75° C.

(4) To the solution, 1.0 cc of 2.11% aqueous solution of potassium hexacyanoferrate(II) is added. After the mixture is stirred, it is left for 60 minutes at 75° C. without stirring.

(5) The mixture is quickly cooled to 40° C. The absorbance is measured at 730 nm by using a spectrophotometer and a cell having the thickness of 10 mm.

In the case that the test compound is not used in the experiments (1) to (5), gelatin reacts with potassium hexacyanoferrate(II) to change $[Fe^{2+}(CN)_6]^{4-}$ of hexacyanoferrate(II) to $[Fe^{3+}(CN)_6]^{3-}$ of hexacyanoferrate(III). The cyano of hexacyanoferrate(III) is then replaced to form cyanogen. The hexacyanoferrate(II) and the hexacyanoferrate(III) form a mixed complex of $Fe^{2+}$ and $Fe^{3+}$, which is colored as Prussian blue. The density of the Prussian blue corresponds to formation of cyanogen. Accordingly, the formation of cyanogen can be determined by measuring the color density. Therefore, the inhibiting function of the test compound can also be determined by the experiments (1) to (5).

The absorbance measured at the experiment (5) depends on the amount of the test compound. Accordingly, the amount of the compound is also determined by the experiments. In more detail, the test compound is used in a silver halide emulsion in an amount showing the absorbance of not higher than 0.4 in the experiments. Further, the amount of the test compound also depends on the amount of gelatin used in the experiments or emulsion. Accordingly, the amount of the compound should be adjusted based on the amount of the gelatin used in the silver halide emulsion. Further, the amount should also be determined by the nature of the compound.

The compound having a function of inhibiting a reaction of the cyano-complex with gelatin preferably satisfies the above-mentioned experiments. Examples of the compounds include salts of metals included in groups IA, IB, IIA, IIB and IVB in the periodic table. Examples of the metals include rubidium, caesium, beryllium, magnesium, calcium, strontium, barium, copper, zinc, cadmium, mercury and lead. Caesium, magnesium, calcium, barium, copper, zinc and lead are preferred. Magnesium, calcium and zinc are more preferred. Zinc is most preferred.

Salts of metals included in the group IIIB and lanthanum series in the periodic table are also available. Examples of the metals of the group IIIB include aluminum, gallium, indium and thallium. Gallium and indium are preferred. Examples of the metals of the lanthanum series include lanthanum, cerium, praseodymium, neodymium, promethium, samarium, europium, gadolinium, terbium, dysprosium, holmium, erbium, thulium, ytterbium and lutetium. Lanthanum, cerium, praseodymium, neodymium, promethium, samarium, europium and gadolinium are preferred.

The counter cation of the metal is not important, since the salt dissociates in an aqueous solvent of the emulsion. However, water-soluble salts are advantageous for precipitation process of silver halide. Therefore, a nitrate salt, a sulfate salt and a chloride salt are preferred.

The inhibiting compound can be added to a silver halide emulsion at various stages in preparation of the emulsion. The compound may be added to a halide solution for formation of the surface part of the silver halide grains. The compound may also be added to the emulsion before or on the formation of the surface part. Further, the compound may be added after the formation of the surface part. The total amount of the compound may be added to the emulsion at once. The compound may also be continuously added. Further, it may be added intermittently. A mixture of the compound with the other additives can also be used.

The amount of the compound is preferably determined by the above-mentioned experiments (1) to (5). The compound relates to the reaction of the hexa-coordinated cyano-complex with gelatin. Accordingly, the amount determined by the experiments (1) to (5) is converted to a value based on 1 g of gelatin. The amount of the compound is then determined based on the amount (g) of gelatin contained in a silver halide emulsion to be prepared. The amount also depends on the nature of the compound. The amount of the compound is generally in the range of $10^{-7}$ to 1 mol, preferably $10^{-5}$ to 1 mol, and more preferably in the range of $4\times10^{-3}$ to 1 mol based on 1 mol of silver.

The silver halide grains are prepared by using gelatin as a protective colloid. An alkali-treated gelatin is frequently used in preparation of a silver halide emulsion. The alkali-treated gelatin is preferably deionized or ultrafiltrated to remove impurities (ion or substance). The other gelatins are also available. The other examples include an acid-treated gelatin, gelatin derivatives (e.g., phthalated gelatin, esterified gelatin), gelatin of a low molecular weight (1,000 to 80,000; e.g., gelatins decomposed with enzyme, acid, alkali or heat), gelatin of a high molecular weight (110,000 to 300,000), gelatin of a low tyrosine content (less than 20 μmol per g), oxidized gelatin and inactivated gelatin that have methionine blocked with alkyl. Two or more gelatins may be used in combination. In formation of silver halide grains, the amount of gelatin is usually in the range of 1 to 60 g, and preferably in the range of 3 to 40 g based on 1 mol of silver. After the formation of grains (e.g., at a chemical sensitization), gelatin is preferably used in an amount of 1 to 100 g, and more preferably in the range of 1 to 70 g based on 1 mol of silver. The present invention is particularly effective in the case that a relatively large amount (more than 10 g based on 1 mol of silver) of gelatin is used.

Examples of the silver halide include silver chloride, silver bromide, silver chlorobromide, silver chloroiodide, silver iodobromide, silver chloroiodobromide and a mixture thereof. The size of the silver halide grains of the invention is preferably not smaller than 0.1 μm, and more preferably in the range of 0.3 to 3 μm. The silver halide grains may be of various crystal forms. Examples of the forms include a regular crystal form (normal crystal grain), an irregular form, and other forms having one or more twinned planes. The regular crystal forms include hexahedron, octahedron, dodecahedron, tetradecahedron, tetracosahedron and octatetracontahedron. The irregular forms include spherical form and potato-like form. Examples of the other forms include hexagonal tabular grain and triangular tabular twin grain each of which has two or three parallel twinning planes. The grain size distribution of the tabular silver halide emulsion preferably is monodispersed.

The preparation of the monodispersed tabular grain is described in Japanese Patent Provisional Publication No. 63(1988)-11928. The monodispersed hexagonal tabular grain is described in Japanese Patent Provisional Publication No. 63(1988)-151618. The monodispersed circular tabular grain is described in Japanese Patent Provisional Publication No. (1989)-131541. Further, Japanese Patent Provisional Publication No. 2(1990)-838 discloses a monodispersed tabular silver halide emulsion, wherein at least 95% of the projected area of the grains comprise tabular grains having two twinning planes that are parallel to the principal plane. European Patent Publication No. 514,742A discloses a monodispersed tabular silver halide emulsion having a distribution coefficient of not more than 10% which is prepared by using a block copolymer of polyalkyleneoxide.

The principal planes of the tabular grains include a (100) plane and a (111) plane. Accordingly, the tabular grains can be classified into two types, namely (100) and (111). Silver bromide grains having the former plane are described in U.S. Pat. No. 4,063,951 and Japanese Patent Provisional Publication No. 5(1993)-281640. Silver chloride grains of the former type are described in European Patent Publication No. 0534395A1 and U.S. Pat. No. 5,264,337. The tabular grains of the latter type include various grains having at least one twinning plane, which are described above. Silver chloride grains of the latter type are described in U.S. Pat. Nos. 4,399,215, 4,983,508, 5,183,732, Japanese Patent Provisional Publications No. 3(1991)-137632 and No. 3(1991)-116113.

The silver halide grains may contain a dislocation line in its crystal. Japanese Patent Provisional Publication No. 63(1988)-220238 discloses a control means of introducing a dislocation into silver halide grains. According to the disclosures, a dislocation can be introduced into a tabular silver halide grain by forming a high iodide phase in the internal part of the grain and then covering the internal part with a low iodide phase. The tabular silver halide grain has an aspect ratio of not less than 2. The aspect ratio means an average diameter of the grains per average thickness of the grains. The introduction of the convention has various effects of increasing sensitivity, improving preservability, improving stability of latent image and reducing pressure fog. According to the invention of the publication, the conversion is mainly introduced into edge parts of the tabular grains. Further, U.S. Pat. No. 5,238,796 discloses tabular grains in which a dislocation is introduced into the internal part. Furthermore, Japanese Patent Provisional Publication No. 4(1992)-348337 discloses regular crystal grains having an internal dislocation. According to the publication, the dislocation is introduced into the regular crystal grains by forming an epitaxy of silver chloride or silver chlorobromide on the regular grains and then converting the epitaxy by a physical ripening or a halogen conversion. The effects of increasing sensitivity and reducing pressure fog are obtained by the introduction of the convention.

The dislocation lines in the silver halide grains can be observed, for example by a direct method using a transparent electron microscope at a low temperature. The method is described in J. F. Hamilton, Photo. Sci. Eng. 11, 57 (1967) and T. Shinozawa, J. Soc. Photo. Sci. Japan 35, 213 (1972). In more detail, silver halide grains are carefully picked out from an emulsion without pressing the grains to form dislocation. The grains are placed on a mesh of an electron microscope. They are then observed by a transparent method while cooling the grains to prevent a damage (print out) caused by an electron beam. It is rather difficult to transmit the electron bean through a thick grain. Accordingly, a high voltage (not lower than 200 KV per 0.25 thickness of the grain) electron microscope is preferably used to observe the thick grain clearly. According to the obtained photograph of the grain, the position and the number of the dislocation lines can be determined by observing along a perpendicular plate to the principal plate of the grain.

The present invention is particularly effective in the case that at least 50% of the silver halide grains have ten or more dislocation lines in each of the grains.

There is no specific limitation with respect to the other additives of the silver halide emulsion.

A silver halide solvent can be used to accelerate the crystal growth or to improve the effect of the grain formation and the chemical sensitization. Examples of the silver halide solvents include thiocyanate salts (preferably water soluble), ammonia, thioethers, thiones, amines, thioureas, imidazoles and mercaptotetrazoles. The thiocyanates are disclosed in U.S. Pat. Nos. 2,222,264, 2,448,534 and 3,320,069. The thioether compounds are disclosed in U.S. Pat. Nos. 3,271, 157, 3,574,628, 3,704,130, 4,297,439 and 4,276,347. The thiones are disclosed in Japanese Patent Provisional Publications No. 53(1978)-144319, No. 53(1978)-82408 and No. 55(1980)-77737. The amines are disclosed in Japanese Patent Provisional Publication No. 54(1979)-100717. The thioureas are described in Japanese Patent Provisional Publication No. 55(1980)-2982. The imidazoles are described in Japanese Patent Provisional Publication No. 54(1979)-100717. Substituted mercaptotetrazoles are described in Japanese Patent Provisional Publication No 57(1982)-202531.

There is also no specific limitation with respect to preparation of a silver halide emulsion. The emulsion is generally prepared by adding aqueous solutions of a silver salt and a halide salt to an aqueous solution of gelatin in a reaction vessel while effectively stirring them. The process for preparation of the emulsion is described in P. Glafkides, Chemie et Phisique Photographique (Paul Montel, 1967), G. F. Duffin, Photographic Emulsion Chemistry (The Focal Press, 1966), and V. L. Zelikman et al, Making and Coating Photographic Emulsion (The Focal Press, 1964). Any of the acid method, the neutral method and the ammonia method is available for preparation of the emulsion. Further, one-side mixing method, simultaneous mixing method and the combination thereof are available with respect to a reaction of a soluble silver salt with a soluble halogen salt.

A controlled double jet process (a kind of the simultaneous mixing method) is also available. In the controlled double jet process, the pAg value of the reaction solution (in which silver halide is formed) is controlled at a constant value. Preferably, the silver halide grains are quickly grown on condition that the concentration of the reaction solution is controlled under the critical supersaturation. For such crystal growth, the rates of adding silver nitrate and alkaline halide can be varied according to the rate of crystal growth, as is disclosed in British Patent No. 1,535,016, Japanese Patent Publications No. 43(1968)-36890 and No. 52(1977)-16364. The concentration of the aqueous solution can also be controlled as is disclosed in U.S. Pat. No. 4,242,445 and Japanese Patent Provisional Publication No. 55(1980)-158124. These processes are preferably used because renucleation of the silver halide does not occur and the grains are homogeneously grown.

All or a part of the nuclear formation or crystal growth of silver halide can be conducted by supplying a silver halide emulsion of fine silver halide grains. The fine silver halide grains are described in Japanese Patent Provisional Publications No. 1(1989)-183417, No. 1(1989)-183644, No. 1(1989)-183645, No. 2(1990)-43534, No. 2(1990)-43535, No. 2(1990)-44335 and U.S. Pat. No. 4,879,208. The distribution of halide ions in the silver halide can be made perfectly uniform by the process using the fine grains. The emulsion having a uniform halide distribution shows an excellent photographic effect.

The gains in the emulsion may have various structures. Examples of the structures include so-called core/shell double-layered structure (which consists of the core and the shell), triple-layered structure (disclosed in Japanese Patent Provisional Publication No. 60(1985)-222844) and multilayered structure consisting of more than three layers. In addition to the layered structures, the grains may have a fused structure, which is disclosed in Japanese Patent Provisional Publications No. 58(1983)-108526 and No. 9(1984)-16254, No. 59(1984)-133540, Japanese Patent Publication No. 58(1983)-24772 and European Patent No. 99,290 A2.

To form a crystal of the fused structure, crystals having the composition different from that of the host crystals (i.e., the guest crystals) are fused at the edge, the corner or the face of the host crystal. Such fused crystals can be prepared whether the host crystal has homogeneous halogen composition or not. For example, even if the host crystal has a core/shell type structure, the fused crystals can be further formed. The fused crystals may consist of a combination of a silver halide and a silver salt that does not have the rock salt structure (e.g., silver rhodanate, silver carbonate) as well as a combination of silver halides.

For example, silver iodobromide grain of core/shell type may contain such iodide distribution that silver iodide content in the core is higher than that in the shell. Further, the grain may have such a structure that silver iodide content in the shell is higher than that in the core. In the case of silver iodobromide grains of fused crystals, the silver iodide content in the host crystals may be higher than that in the guest crystal. The content in the guest crystal may also be higher than that in the host crystal. In the above-described grains consisting of two or more portions in which compositions of silver halide are different each other, the portions can be distinguished by a clear border. The border can also be vague. Mixed crystals of adjoining parts have such a vague border. Further, the composition may be gradually changed between the portions.

The silver halide emulsion may be so treated that the grains be rounded, as is described in European Patents No. 0,096,727B1 and No. 0,064,412B1. Further, the surface of the grains can be modified, as is described in German Patent No. 2,306,447C2 and Japanese Patent Provisional Publication No. 60(1985)-221320.

A silver halide emulsion of surface latent image type is preferred. An emulsion of internal latent image type is also available, if developers and developing conditions are appropriately selected (as is described in Japanese Patent Provisional Publication No. 59(1084)-133542). Further, an emulsion of shallow-internal latent image type (such emulsion contains the grains covered with thin shell) is optionally usable.

The silver halide emulsion is generally subjected to a spectral sensitization. Examples of spectral sensitizing dyes include cyanine dyes, merocyanine dyes, complex cyanine dyes, complex merocyanine dyes, holopolar cyanine dyes, hemicyanine dyes, styryl dyes and hemioxonol dyes. Examples of preferred dyes include cyanine dyes, merocyanine dyes and complex merocyanine dyes. The dyes may have a basic heterocyclic ring, which is usually contained in the cyanine dyes. Examples of the heterocyclic rings include pyrroline ring, oxazoline ring, thiazoline ring, selenazoline ring, pyrrole ring, oxazole ring, thiazole ring, selenazole ring, imidazole ring, tetrazole ring, pyridine ring and tellurazole ring. The heterocyclic ring may be condensed with an alicyclic hydrocarbon ring or an aromatic hydrocarbon ring. Examples of the condensed rings include indolenine ring, benzindolenine ring, indole ring, benzoxazole ring, naphthooxazole ring, benzimidazole ring, naphthoimidazole ring, benzothiazole ring, naphthothiazole ring, benzoselenazole ring, naphthoselenazole ring and quinoline ring. The heterocyclic ring of the dye may have a substituent group on its carbon atom.

Merocyanine dyes and complex merocyanine dyes may contain a ring having a ketomethylene structure, which is usually contained in merocyanine dyes. The rings of the ketomethylene structure preferably are 5- or 6-membered beterocyclic rings such as pyrazoline-5-one ring, thiohydantoin ring, 2-thiooxazolidine-2,4-dione ring, thiazolidine-2,4-dione ring, rhodanine ring and thiobarbituric acid ring.

The amount of the sensitizing dye is preferably in the range of 0.001 to 100 mmol, and more preferably in the range of 0.01 to 10 mmol based on 1 mol of silver halide. The sensitizing dye is preferably used on or before a chemical sensitization (e.g., at the stage of forming grains or physical ripening).

The sensitivity of silver halide grains to inherent light absorption after a sensitization (inherent sensitivity) is improved according to the present invention. Namely, desensitization caused by a spectral sensitizing dye is reduced by a hexa-coordinated cyano-complex present in the surface part. The spectral sensitizing dye is adsorbed on the grains of emulsion, and is sensitive to a light of about 450 nm or more (inherent desensitization of sensitizing dye). According to study of the present inventor, the effect of reducing inherent desensitization is remarkable where the hexa-coordinated cyano-complex is present in the surface part. The present invention has another effect of reducing inherent desensitization caused by a sensitizing dye.

The sensitizing dye may be also used in combination with a supersensitizer, which themselves cannot spectrally sensitize the emulsions or cannot absorb visible light. Examples of the supersensitizers include aminostil compounds substituted with nitrogen-containing heterocyclic groups (disclosed in U.S. Pat. Nos. 2,933,390 and 3,365,721), condensed compounds of an aromatic acid with formaldehyde (described in U.S. Pat. No. 3,743,510), cadmium salts and azaindene compounds. The combinations of the sensitizing dye with the supersensitizers are described in U.S. Pat. Nos. 3,615,613, 3,615,641 and 3,635,721.

The silver halide emulsion is usually chemically sensitized. Examples of the chemical sensitizations include chalcogen sensitizations (e.g., sulfur sensitization, selenium sensitization and tellurium sensitization), noble metal sensitizations (e.g., gold sensitization) and reduction sensitizations. The present invention is particularly effective in the case that a gold sensitizer is used singly or in combination with the other sensitizers.

The gold sensitizer usually is a salt of gold. The gold sensitizers are disclosed in "Chemie et Phisique Photographique (Paul Montel, 1970)" written by P. Glafkides and Research Disclosure, volume 307, No. 307105. Examples of the gold sensitizers include chloroauric acid, potassium chloroaurate, potassium aurithiocyanate, gold sufide, gold selenide and gold compounds, which are described in U.S. Pat. Nos. 2,642,361, 5,049,484 and 5,049,485.

The other noble metal sensitizers, such as salts of platinum, palladium and iridium can be used in combination with the gold sensitizer. The amount of the gold sensitizer (and the other noble metal sensitizers) is preferably $10^{-7}$ to $10^{-2}$ mol per 1 mol of silver.

Each of Photographic Science and Engineering volume 19322 (1975) and Journal of Imaging Science Vol. 3228 (1988) describes that gold can be removed from a sensitizing speck on the grains of an emulsion using a solution of potassium cyanide (KCN). They further describe that a cyanide liberates an absorbed gold atom or ion from the silver halide grains as a cyano-complex to inhibit a gold sensitization. According to the present invention, formation of the cyanogen is inhibited to obtain a full effect of the gold sensitization.

Sulfur sensitization is carried out using a labile sulfur compound as a sulfur sensitizer. The labile sulfur compounds are well known and disclosed in "Chemie et Phisique Photographique (Paul Morttel, 1970)" written by P. Glafkides and Research Disclosure, volume 307, No. 307105. Examples of sulfur sensitizers include thiosulfates (e.g., sodium thiosulfate), thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethylrhodanine, 5-benzylidene-N-ethyl-rhodanine), phosphinesulfides (e.g., trimethylphosphinesulfide), thiohydantoins, 4-oxo-oxazoli- dine-2-thiones, disulfides or polysulfides (e.g., dimorpholinedisulfide, cystine, hexathiocane-thione), mercapto compounds (e.g., cysteine), polythionic acid salts, simple body of sulfur and active gelatin.

Selenium sensitization is carried out using a labile selenium compound as a selenium sensitizer. The labile selenium compounds are disclosed in Japanese Patent Publications No. 43(1968)-13489 and No. 44(1969)-15748, Japanese Patent Provisional Publications No. 4(1992)-25832 and No. 4(1992)-109240 and Japanese Patent Applications No. 3(1991)-53693 and No. 3(1991)-82929. Examples of the selenium sensitizers include colloidal metal selenium, selenoureas (e.g., N,N-dimethylselenourea, trifluoromethylcarbonyl-trimethylselenourea and acetyltrimethylselenourea), selenoamides (e.g., selenoacetamide, N,N-diethylphenylselenoamide), phosphineselenides (e.g., triphenylphosphineselenide and pentafluorophenylphosphineselenide), selenophosphates (e.g., tri-p-tolylselenophosphate, tri-n-butylselenophosphate), selenoketones (e.g., selenobenzophenone), isoselenocyanates, selenocarboxylic acids, selenoesters and diacylselenides. Selenium compounds disclosed in Japanese Patent Publications No. 46(1971)-4553 and No. 52(1977)-34492 are also available, though they are not labile compounds. Examples of the relatively stable selenium compounds include selenious acid, potassium selenocyanate, selenazoles and selenides.

Tellurium sensitization is carried out using a labile tellurium compound as a tellurium sensitizer. The labile tellurium compounds are disclosed in Canadian Patent No. 00,958, U.K. Patents No. 1,295,462 and No. 1,396,696, and Japanese Patent Applications No. 2(1990)-333819, No. (1991)-53693, No. 3(1991)-131593 and No. 4(1992)-129787. Examples of the tellurium sensitizers include telluroureas (e.g., tetramethyltellurourea, N,N'-dimethylethylenetellurourea and N,N'-diphenylethylenetellurourea), phosphinetellurides (e.g., butyldiisopropylphosphinetelluride, tributylphosphinetelluride, tributoxyphosphinetelluride and ethoxydiphenylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride and bis(ethoxycarbonyl)telluride), isotellurocyanates, telluroamides, tellurohydrazides, telluroesters (e.g., butylhexyltelluroester), telluroketones (e.g., telluroacetophenone), colloidal metal tellurium, (di)tellurides, and other tellurium compounds (e.g., potassium telluride, sodium telluropentathionate).

Reduction sensitization is carried out using known reducing compounds, which are disclosed in "Chemie et Phisique Photographique (Paul Montel, 1970)" written by P. Glafkides and Research Disclosure, volume 307, No. 307105. Examples of the reducing compounds include aminoiminomethanesulfinic acid (i.e., thiourea dioxide), borane compounds (e.g., dimethylaminoborane), hydrazine compounds (e.g., hydrazine and p-tolylhydrazine), polyamine compounds (e.g., diethylenetriamine and triethylenetetramine), tin(II) chloride, silane compounds, reductones (e.g., ascorbic acid), sulfites, aldehydes and hydrogen gas. Reduction sensitization can also be carried out under condition of a high pH or condition of silver excess. The reduction sensitization under the silver excess condition is called "silver ripening."

Two or more chemical sensitizations can be carried out in combination with the gold sensitization. A combination of a chalcogen sensitization with a gold sensitization is particularly preferred. The reduction sensitization is preferably carried out while forming silver halide grains.

The amount of the chalcogen sensitizer used for the invention depends on the silver halide grains and the conditions of chemical sensitization. The chalcogen sensitizer is preferably used in an amount of $10^{-8}$ to $10^{-2}$ mol, and more preferably used in an amount of $10^{-7}$ to $5\times10^{-3}$ mol based on 1 mol of silver.

With respect to the condition of chemical sensitization, the pAg value is preferably in the range of 6 to 11, and more preferably in the range of 7 to 10. The pH value is preferably in the range of 4 to 10. The temperature is preferably in the range of 40° to 95° C., and more preferably in the range of 45° to 85° C.

The photographic emulsion may contain various additives such as stabilizer and anti-fogging agent to stabilize the photographic properties of the photographic material or to inhibit the fog at the processes for preparing, storing or treating the photographic material. Examples of the additives include azoles such as benzothiazolium salts, nitroindazoles, triazoles, benzotriazoles and benzimidazoles (nitro-substituted or halogen substituted benzimidazoles is particularly preferred); heterocyclic mercapto compounds such as mercaptothiazoles, mercaptobenzothiazoles, mercaptobenzimidazoles, mercaptothiadiazoles, mercaptotetrazoles (1-phenyl-5-mercaptotetrazole is particularly preferred) and mercaptopyrimidines; the compound synthesized by adding water-soluble group such as carboxyl group and sulfo group to the above-mentioned heterocyclic mercapto compounds; thioketo compounds such as oxazolinethione; azaindenes such as tetrazaindenes (4-hydroxy substituted (1,3,3a,7)-tetrazaindenes are particularly preferred); benzenethiosulfonic acids; and benzenethiosulfinic acids.

The above-mentioned stabilizers and anti-fogging agents are added usually after a chemical sensitizer is added to a silver halide emulsion. However, they may be added to an emulsion on or before a chemical sensitization. Further, they may be added to the emulsion in formation of silver halide grains (e.g., at addition of a solution of a silver salt). When they are added to the emulsion while the chemical sensitization, they are preferably added at an earlier stage (preferably 50%, and more preferably 20% of the sensitizing time) of the sensitization.

The silver halide emulsion can be used for a photographic material having any number of emulsion layers. For example, the emulsion can be used for a multi-layered color photographic material, which comprises three or more emulsion layers to record images of green, blue and red light on each layer independently. The layer may comprise at least two sub-layers (e.g., a low sensitive sub-layer and a high sensitive sub-layer).

Examples of the layered structures of the photographic material are shown below.

(1) BH/BL/GH/GL/RH/RL/S (2) BH/BM/BL/GH/GM/BL/RH/RM/RL/S (3) BH/BL/GH/RH/GL/RL/S (4) BH/GH/RH/BL/GL/RL/S (5) BH/BL/CL/GH/GL/RH/RL/S (7) B/HIBLIG/H/GL/CL/R/H/RL/S

In the orders (1) to (7), B means a blue sensitive layer, G means a green sensitive layer, R means a red sensitive layer, H means a high sensitive layer, M means a middle sensitive layer, and L means a low sensitive layer. Further, S means a support and CL means a layer having an interimage effect. A photographic material may further have the other layers, such as a protective layer, a filter layer, an intermediate layer, an antihalation layer and an undercoating layer, which are omitted from the orders (1) to (7). The order of the high and low sensitive layers with respect to the same spectral sensitivity may be arranged reversibly.

The order (3) is described in U.S. Pat. No. 4,184,876. The order (4) is described in RD-22534, Japanese Patent Provisional Publications No. 59(1984)-77551 and No. 59(1984)-177552. The orders (5) and (6) are described in Japanese Patent Provisional Publication No. 61(1986)-34541. The orders (1), (2) and (4) are preferred.

In addition to the color photosensitive material described above, the photographic material of the present invention is also available for the other photographic materials, such as a X-ray photographic material, a black and white photographic material, a photographic presensitized plate and a photographic paper.

In the present invention, there is no specific limitation with respect to the other additives, the support and the coating, exposing and developing processes. Examples of the additives include a binder, a chemical sensitizer, a spectral sensitizer, a stabilizer, a gelatin hardening agent, a surface active agent, an antistatic agent, a polymer latex, a matting agent, a color coupler, a UV absorber, a discoloration inhibitor and a dye. The details are described in Research Disclosure, volume 176, item 17643 (RD-17643); ibid., vol. 187, item 18716 (RD-18716); and ibid., vol. 225, item 22534 (RD-22534).

The descriptions in the Research Disclosure are shown below.

| | Additives | RD-17643 | RD-18716 | RD-22534 |
|---|---|---|---|---|
| 1 | Chemical sensitizer | page 23 | page 648 (right column) | page 24 |
| 2 | Sensitivity increasing agent | | page 648 (right column) | |
| 3 | Spectral sensitizer and Supersensitizer | pages 23–24 | page 648 (right column) to page 649 (right column) | pages 24–28 |
| 4 | Brightening agent | page 24 | | |
| 5 | Anti-fogging agent and stabilizer | pages 24–25 | page 649 (right column) - | pages 24 and 31 |
| 6 | Light-absorber, Filter dye and UV absorber | pages 25–26 | page 649 (right column) to page 650 (left column) | |
| 7 | Anti-stain agent | page 25 (right column) | page 650 (left column to right column) | |
| 8 | Color-image stabilizer | page 25 | | page 32 |
| 9 | Hardening agent | page 26 | page 651 (left column) | page 28 |
| 10 | Binder | page 26 | page 651 (left column) | |
| 11 | Plasticizer and Slipping agent | page 27 | page 650 (right column) | |
| 12 | Coating aid and surface active agent | pages 26–27 | page 650 (right column) | |
| 13 | Antistatic agent | page 27 | page 650 (right column) | |
| 14 | Color coupler | page 25 | page 649 | page 31 |

A hardening agent rapidly hardens a hydrophilic colloid such as gelatin to stabilize the photographic properties. Examples of the hardening agent include active halogen compounds (e.g., 2,4-dichloro-6-hydroxy-l,3,5-triazine and its sodium salt); active vinyl compounds (e.g., 1,3-bisvinylsulfonyl-2-propanol, 1,2-bis(vinylsulfonylacetamide)ethane, vinyl polymer having vinylsulfonyl group connecting to the side chain); N-carbamoylpyridinium salts (e.g., 1-morpholinocarbonyl-3-pyridinio)methanesulfonate); and haloamidinium salts (e.g., 1-(1-chloro-1-pyridinomethylene)pyrrolidinium- 2-naphthalenesulfonate). Active halogen compounds and active vinyl compounds are preferred, because they remarkably stabilize the photographic properties.

A color photographic material is usually treated with a conventional color development, which is described at pages 28 to 29 in RD-17643 and at the left to right columns of page 651 of RD-18716.

After the color development, the color photographic material is usually treated with a bleach-fix or fix process and a washing or stabilizing process.

The washing process is generally carried out according to a countercurrent replenishing method using two or more washing tanks. The stabilizing process can be carried out instead of washing. A typical example of the stabilizing process is a multistage countercurrent stabilizing treatment, which is described in Japanese Patent Provisional Publication No. 57(1982)-8543.

PRELIMINARY EXPERIMENT 1

The following preliminary experiments (1) to (5) were conducted with respect to sample compounds.

(1) Bovine bone gelatin obtained from slaughterhouse was lime-treated and deionized. The calcium content of the gelatin was not more than 50 ppm. The isoelectric point of the gelatin was in the range of 5 0±0.05 At 40° to 45° C. 3 g of the gelatin was dissolved in (49-X) cc of distilled water in a glass container. The X cc means the amount of the test sample solution used in the experiment (2). The pH of the solution was analogous to the isoelectric point of the gelatin.

(2) Each of the following sample solutions of test compounds was added to the gelatin solution, and the mixture was adjusted to pH of 5.0±0.05. In the table shown below, the concentration means mol (compound) per liter (solution).

| Test No. | Compound | Concentration | Amount (× cc) |
|---|---|---|---|
| 1 | $Zn(NO_3)_2.6H_2O$ | $6.0 \times 10^{-2}$ M | 10.0 cc |
| 2 | $Zn(NO_3)_2.6H_2O$ | $6.0 \times 10^{-2}$ M | 5.0 cc |
| 3 | $Zn(NO_3)_2.6H_2O$ | $6.0 \times 10^{-2}$ M | 1.0 cc |
| 4 | $CsNO_3$ | $6.0 \times 10^{-2}$ M | 10.0 cc |
| 5 | $Ca(NO_3)_2.4H_2O$ | $1.3 \times 10^{-1}$ M | 20.0 cc |
| 6 | $Ca(NO_3)_2.4H_2O$ | $6.0 \times 10^{-2}$ M | 10.0 cc |
| 7 | $Ba(NO_3)_2$ | $1.3 \times 10^{-1}$ M | 10.0 cc |
| 8 | $KNO_3$ | $6.0 \times 10^{-2}$ M | 10.0 cc |
| 9 | $Na_2SO_4$ | $6.0 \times 10^{-2}$ M | 10.0 cc |
| 10 | None | — | — |

(3) The gelatin solution was heated to 75° C.

(4) To the solution, 1.0 cc of 2.11% aqueous solution of potassium hexacyanoferrate(II) was added. After the mixture was stirred, it was left for 60 minutes at 75° C. without stirring.

(5) The mixture was quickly cooled to 40° C. The absorbance was measured at 730 nm by using a spectrophotometer and a cell having the thickness of 10 mm. The results are set forth in Table 1-A.

TABLE 1-A

| No. | | | | | | | | | |
|---|---|---|---|---|---|---|---|---|---|
| 1 | 2 | 3 | 4 | 5 | 6 | 7 | 8 | 9 | 10 |
| 0.12 | 0.02 | 0.12 | 0.25 | 0.30 | 1.10 | 0.35 | 1.30 | 1.33 | 1.35 |

The absorbance of the test number 1 (0.12) was caused by a contamination. A blue color was not observed in the test number 1. In the test number 2, neither color nor contamination was observed. The test number 10 is a control in which no additive was used.

In the test number 1, the contamination was caused by a reaction of a large amount of zinc with gelatin. However, no Prussian blue color was formed in the test number 1. In the test number 2, neither color nor contamination was observed by using an appropriate amount of zinc. In addition to Zn ion, Cs, Ca and Ba ions are effective to prevent color. On the other hand, K, Na, $NO_3$ and $SO_4$ ions are not effective. The absorbance depends on the amount of the compound. However, the compounds showing no effects on Table 1 are still not effective even if a large amount of the compounds are used.

PRELIMINARY EXPERIMENT 2

The following sample solutions of test compounds were evaluated in the same manner as in Preliminary experiment 1. The results (Densities) are set forth in Table 1-B.

| Test No. | Compound | Concentration | Amount (× cc) |
|---|---|---|---|
| 11 | $Al(NO_3)_3.9H_2O$ | 1.26% | 13 cc |
| 12 | $Ga(NO_3)_3.nH_2O$ | 1.22% | 13 cc |
| 13 | $In_2(SO_4)_3.nH_2O$ | 0.93% | 6 cc |
| 14 | $LaCl_3.7H_2O$ | 1.25% | 13 cc |
| 15 | $Ce(NO_3)_3.6H_2O$ | 1.46% | 13 cc |
| 16 | $Pr(NO_3)_2.nH_2O$ | 1.46% | 16 cc |
| 17 | $Nd(NO_3)_2.6H_2O$ | 1.47% | 16 cc |
| 10 | None | — | — |

TABLE 1-B

| No. | | | | | | | |
|---|---|---|---|---|---|---|---|
| 11 | 12 | 13 | 14 | 15 | 16 | 17 | 10 |
| 0.08 | 0.08 | 0.02 | 0.12 | 0.16 | 0.16 | 0.17 | 1.35 |

EXAMPLE 1

Emulsion I-A: octahedral silver bromide emulsion (Comparison Example).

In 870 cc of water were dissolved 36 g of deionized lime-treated bone gelatin and 0.25 g of potassium bromide. The pH of the gelatin solution was 5.0. To the mixture, 36 cc of 0.088M (mol per liter) silver nitrate aqueous solution (Solution 1) and 36 cc of 0.088M (mol per liter) potassium bromide aqueous solution (Solution 2) were added for 10 minutes while stirring at 75° C. Then, 176 cc of Solution 1 and Solution 2 were further added to the mixture according to a normal double-jet method for 7 minutes. After 1.4 g of potassium bromide was further added to the obtained solution, 1010 cc of 0.82M silver nitrate aqueous solution (Solution 3) was added with increasing the adding rate from 1.8 cc per minute for 78 minutes. During this addition of Solution 3, 0.90M potassium bromide aqueous solution (Solution 4) was added at the same time so that the electric potential of silver might be kept at 0 mV (vs. saturated calomel electrode). Then, 578 cc of 0.51M silver nitrate aqueous solution (Solution 5) and 578 cc of 0.51M potassium bromide aqueous solution (Solution 6) were added at the constant rate for 24 minutes. The pH of the mixture was adjusted to 5.3. After that, the resulting solution was cooled to 35° C. and then water-soluble salts were removed according to a conventional precipitation method The obtained solution was heated to 40° C. and 50 g of gelatin and 420 cc of water were further added to and dissolved in the solution. The solution was adjusted to pH 6.3 and pAg 8.6. Thus, prepared was a silver halide emulsion (an octahedral silver bromide monodispersed emulsion). The mean diameter of the circle corresponding to the projected area was 0.8 μm, and the distribution coefficient was 10%.

Emulsion I-B: a comparative emulsion having a surface part doped with a hexa-coordinated cyano-complex (Comparison Example)

The procedure of the above-mentioned preparation of Emulsion 1-A was repeated except that $5\times10^{-4}$M of $K_4[Fe(CN_6]$ was dissolved in the Solution 6.

Emulsions 1-C to 1-I: emulsions of the present invention having a surface part doped with a hexa-coordinated cyano-complex and containing various additives The procedure of the above-mentioned preparation of Emulsion 1-B was repeated except that each of the additives shown in Table 2 was added to the mixture of the emulsion with 50 g of gelatin and water at 40° C. after the emulsion was washed with water.

Each of Emulsions 1-A to 1-I was subject to an optimum chemical sensitization at 60° C. using $1.2\times10^{-5}$ mol/mol Ag of sodium thiosulfate, $3.6\times10^{-6}$ mol/mol Ag of potassium chloroaurate and $5.1\times10^{-4}$ mol/mol Ag of potassium thiocyanate. The obtained emulsion was coated on a transparent film in the amount of 2 g/m$^2$.

Independently, after chemical sensitization, each of the emulsions was subject to spectral sensitization using $2.5\times10^{-4}$ mol/mol Ag of the following spectral sensitizing dye was added, and the resulting emulsion was left for 20 minute at 40° C. so that the dye was adsorbed on the silver halide grains in the emulsion. The obtained spectrally sensitized emulsion was also coated on a transparent film in the amount of 2 g/m$^2$.

(Sensitizing dye)

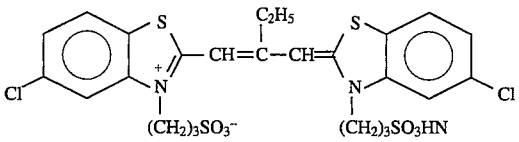

Each of the samples was exposed to blue light for 1 second. The emulsions were developed at 20° C. for 10 minutes with the following MAA-1 Developer.

| MAA-1 Developer | |
|---|---|
| Metol | 2.5 g |
| L-ascorbic acid | 10.0 g |
| Nabox | 35.0 g |
| KBr | 1.0 g |
| $H_2O$ | 1 liter |

With respect to the obtained images, (1) a relative blue sensitivity, (2) a gradation and (3) a difference in the inherent reduction of sensitivity were evaluated in the following manner.

(1) The a relative blue sensitivity means a relative reciprocal value of the exposure giving the density of 0.1+ fog in the samples that were not subjected to spectral sensitization.

(2) The gradation means a slope of a straight line portion in the characteristic curve of the samples that were not subjected to spectral sensitization. The larger slope means the higher contrast.

(3) The difference in the inherent reduction of sensitivity means a difference of the logarithm of the exposure (E) giving the density of 0.1+ fog (i.e., the density thicker than the fogged base by 0.1) between a sample that was not subjected to spectral sensitization and a sample that was subjected to spectral sensitization.

The results are set forth in Table 2. In Table 2, the concentration means the concentration of the compound in the solution. The (cc) means the amount of the solutions.

TABLE 2

| No. | Compound | Concentration | (cc) | (1) | (2) | Δlog E (3) |
|---|---|---|---|---|---|---|
| 1-A | — | — | — | 100 | 1.5 | −0.70 |
| 1-B | — | — | — | 70 | 1.95 | −0.30 |
| 1-C | $Zn(NO_3)_2.6H_2O$ | $6.0\times10^{-2}$ | 40 | 115 | 1.9 | −0.25 |
| 1-D | $CsNO_3$ | $6.0\times10^{-2}$ | 83 | 100 | 1.9 | −0.30 |
| 1-E | $Ca(NO_3)_2.4H_2O$ | $3.5\times10^{-1}$ | 90 | 95 | 1.85 | −0.25 |
| 1-F | $Ca(NO_3)_2.4H_2O$ | $6.0\times10^{-2}$ | 42 | 70 | 1.9 | −0.30 |
| 1-G | $Ba(NO_3)_2$ | $3.5\times10^{-1}$ | 83 | 90 | 1.85 | −0.32 |
| 1-H | $KNO_3$ | $6.0\times10^{-2}$ | 83 | 70 | 1.85 | −0.35 |
| 1-I | $Na_2SO_4$ | $6.0\times10^{-2}$ | 83 | 65 | 1.90 | −0.30 |

As is evident from the comparison between the emulsion 1-A and the emulsion 1-B, the gradation of the doped emulsion 1-B is high. On the other hand, the difference in the inherent reduction of sensitivity is small in the doped emulsion. Further, the sensitivity at one second blue light exposure is small in the doped emulsion 1-B. These results mean that the doping of the hexa-coordinated cyano-complex remarkably inhibits the inherent reduction of sensitivity caused by the spectral sensitizing dye, but decreases the inherent sensitivity of the emulsion itself.

According to the present invention, the emulsions 1-C, 1-D, 1-E and 1-G show the gradation and the difference in the inherent reduction of sensitivity that are analogous to those of the doped emulsion 1-B. Further, the blue sensitivity is improved, compared with the emulsion 1-B. Accordingly, the problem of the doped emulsion 1-B is now solved by the present invention. The emulsion 1-F uses $Ca(NO_3)_2.4H_2O$ in the same manner as in the emulsion 1-E, except that the amount is small. The amount in the emulsion 1-F corresponds to that of the number 5 in the preliminary experiment. On the other hand, the amount in the emulsion 1-E is larger than that of the number 6 in the preliminary experiment.

The lime-treated gelatin generally contains $Ca^{2+}$ ion, which is usually not more than 4,000 ppm based on 1 g of gelatin. In preparation of the emulsion 1-F, $Ca^{2+}$ ion is added to the emulsion. The added amount is about 4,000 ppm based on 1 g of gelatin. Accordingly, the effect of the present invention cannot be obtained by using only a conventional lime-treated gelatin. Even if the lime-treated gelatin is used, a considerable amount of $Ca^{2+}$ -ion should be added to the gelatin to obtain the effect of the present invention.

As is shown in the preliminary experiment, $KNO_3$ and $Na_2SO_4$ do not have a function of inhibiting a reaction of the cyano-complex with gelatin. These compounds do not show any effects on the emulsion, as is shown in Table 2. Therefore, it is apparent that the effect of the present invention shown in Table 2 is obtained by the inhibiting function

EXAMPLE 2

Emulsion 3-A: cubic silver bromide emulsion (Comparison Example)

In 870 cc of water were dissolved 36 g of deionized lime-treated bone gelatin and 0.25 g of potassium bromide. The pH of the gelatin solution was 5.0. To the mixture, 36 cc of 0.088M (mol per liter) silver nitrate aqueous solution (Solution 1) and 36 cc of 0.088M (mol per liter) potassium bromide aqueous solution (Solution 2) were added for 10 minutes while stirring at 75° C. Then, 176 cc of Solution 1 and Solution 2 were further added to the mixture according to a normal double-jet method for 7 minutes. Then, 1010 cc of 0.82M silver nitrate aqueous solution (Solution 3) was added with increasing the adding rate from 1.8 cc per minute for 78 minutes. During this addition of Solution 3, 0.90M potassium bromide aqueous solution (Solution 4) was added at the same time so that the electric potential of silver might be kept at 0 mV (vs. saturated calomel electrode). Further, 578 cc of 0.51M silver nitrate aqueous solution (Solution 5) and 578 cc of 0.51M potassium bromide aqueous solution (Solution 6) were added for 24 minutes while controlling +100 mV. The pH of the mixture was 5.3. After that, the resulting solution was cooled to 35° C. and then water-soluble salts were removed according to a conventional precipitation method. The obtained solution was heated to 40° C. and 50 g of gelatin and 420 cc of water were further added to and dissolved in the solution. The solution was adjusted to pH 6.3. Thus, prepared was a silver halide emulsion (a cubic silver bromide monodispersed emulsion). The mean length of the cube was 0.65 μm, and the distribution coefficient was 9%.

Emulsions 3-B to 3-E: comparative emulsions having a surface part doped with a hexa-coordinated cyano-complex (Comparison Example)

The procedure of the above-mentioned preparation of Emulsion 3-A was repeated except that $5\times10^{-4}$M of $K_4[Fe(CN)_6]$, $K_3[Fe(CN)_6]$, $K_4[Ru(CN)_6]$ or $K_3[Ir(CN)_6]$ was dissolved in the Solution 6.

Emulsion 3-F: a comparative emulsion containing a zinc compound (Comparison Example)

The procedure of the above-mentioned preparation of Emulsion 3-A was repeated except that 50 cc of an aqueous solution containing $8.5\times10^{2}$M of $Zn(NO_3)_2$. $6H_2O$ was added to the mixture of the emulsion with 50 g of gelatin and water at 40° C. after the emulsion was washed with water.

Emulsions 3-G to 3-J: emulsions of the present invention having a surface part doped with a hexa-coordinated cyano-complex and containing a zinc compound The procedure of the above-mentioned preparation of Emulsions 3-B to 3-E was repeated except that 50 cc of an aqueous solution containing $8.5\times10^{2}$M of $Zn(NO3_2$. $6H_2O$ was added to the mixture of the emulsion with 50 g of gelatin and water at 40° C. after the emulsion was washed with water.

Each of Emulsions 3-A to 3-J was subject to an optimum chemical sensitization at 60° C. using $9.2\times10^{-6}$ mol/mol Ag of sodium thiosulfate, $2.1\times10^{-6}$ mol/mol Ag of potassium chloroaurate and $2.5\times10^{-4}$ mol/mol Ag of potassium thiocyanate. The obtained emulsion was coated on a transparent film in the amount of 2 g/m$^2$. Thus, the coated samples 3-A to 3-J were obtained.

Independently, after chemical sensitization, each of the emulsions was subject to spectral sensitization using $3.8\times10^{-4}$ mol/mol Ag of the spectral sensitizing dye of Example 1 was added, and the resulting emulsion was left for 20 minutes at 40° C. so that the dye was adsorbed on the silver halide grains in the emulsion. The obtained spectrally sensitized emulsion was also coated on a transparent film in the amount of 2 g/m$^2$. Thus, the spectrally sensitized coated samples 3-a to 3-j were obtained.

Each of the samples was exposed to blue light for $10^{-3}$ second using an EG & G sensitometer. The emulsions were developed at 20° C. for 10 minutes with the MAA-1 Developer used in Example 1.

With respect to the obtained images, (1) a relative blue sensitivity, (2) a gradation and (3) a difference in the inherent reduction of sensitivity were evaluated in the following manner.

(1) The a relative blue sensitivity means a relative reciprocal value of the exposure giving the density of 0.1+ fog in the samples that were not subjected to spectral sensitization (3-A to 3-J).

(2) The gradation means a slope of a straight line portion in the characteristic curve of the samples that were not subjected to spectral sensitization (3-A to 3-J). The larger slope means the higher contrast.

(3) The difference in the inherent reduction of sensitivity means a difference of the logarithm of the exposure (E) giving the density of 0.1 +fog (i.e., the density thicker than the fogged base by 0.1) between a sample that was not subjected to spectral sensitization (3-A to 3-J) and a sample that was subjected to spectral sensitization (3-a to 3-j).

The results are set forth in Table 3.

TABLE 3

| No. | Dopant | Zinc | (1) | (2) | (3) |
|---|---|---|---|---|---|
| 3-A | — | — | 100 | 1.3 | −0.40 |
| 3-B | $K_4[Fe(CN)_6]$ | — | 50 | 1.7 | −0.20 |
| 3-C | $K_3[Fe(CN)_6]$ | — | 45 | 1.7 | −0.22 |
| 3-D | $K_4[Ru(CN)_6]$ | — | 55 | 1.75 | −0.15 |
| 3-E | $K_3[Ir(CN)_6]$ | — | 50 | 1.65 | −0.27 |
| 3-F | — | added | 90 | 1.4 | −0.40 |
| 3-G | $K_4[Fe(CN)_6]$ | added | 105 | 1.75 | −0.22 |
| 3-H | $K_3[Fe(CN)_6]$ | added | 105 | 1.65 | −0.24 |
| 3-I | $K_4[Ru(CN)_6]$ | added | 105 | 1.75 | −0.20 |
| 3-J | $K_3[Ir(CN)_6]$ | added | 100 | 1.65 | −0.25 |

As is evident from the Table 3, the doped emulsion 3-B to 3-E are greatly improved with respect to the inherent reduction of sensitivity caused by the spectral sensitizing dye and the gradation. However, the inherent sensitivities of the doped emulsions themselves are very low.

According to the present invention, the emulsions 3-G to 3-J are doped and contained the zinc compound of $Zn(NO_3)_2$. $6H_2O$. The emulsions of the present invention are improved in the blue sensitivity as well as the gradation and the difference in the inherent reduction of sensitivity. The zinc compound itself has no photographic effect, as is shown in the results of the emulsion 3-F, which are analogous to the results of the emulsion 3-A. Accordingly, the zinc compound is only effective on the emulsions doped with a hexa-coordinated cyano-complex. Therefore, the zinc compound prevents the formation of cyanogen caused by a reaction of the hexa-coordinated cyano-complex with gelatin used in the doped emulsion, which is prepared by doping the surface part of the grains with the complex.

EXAMPLE 3

Emulsion 4-A: tabular silver iodobromide emulsion (Comparison Example)

In 1.5 liter of 0.8% gelatin (molecular weight: 10,000) solution containing 0.05 mol of potassium bromide, 15 cc of 0.5M silver nitrate solution and 15 cc of 0.5M potassium bromide solution were added for 15 seconds while stirring according to a double jet method while keeping the gelatin solution at 40° C. Thus the core of the grain was formed. The pH of the core formation was 5.0.

After the core formation, the core emulsion was heated to 75° C. To the emulsion, 220 cc of 10% aqueous solution of deionized lime-treated bone gelatin was added. The emulsion was ripened for 20 minutes. Then, 805 cc of 0.47M silver nitrate solution was added to the emulsion, and the emulsion was further ripened.

After 10 minutes for ripening, 150 g of silver nitrate and a potassium bromide solution containing 5 mol % of potassium iodide were added to the emulsion for 60 minutes to grow the grains according to a controlled double jet method while keeping pBr of 2.55 and the electric potential at 0 mV. The adding rate was accelerated and so controlled that the finished rate was 19 times the first rate. After the grain growth, 30 cc of 10% potassium iodide solution was added to the emulsion. The emulsion was adjusted to pH 7.0 using 1N aqueous solution of sodium hydroxide. Further, 327 cc of 0.5M silver nitrate solution and 327 cc of 0.5M potassium bromide solution were added to the emulsion for 20 minutes at the electric potential of 0 mV to form the shell according to the controlled double jet method.

After the shell formation, the emulsion was cooled to 35° C. Then, water-soluble salts were removed according to a conventional precipitation method. The obtained solution was heated to 40° C. and 80 g of deionized alkali-treated gelatin was dissolved in the emulsion. The solution was adjusted to pH 6.5 and pAg 8.6 and stored in a dark and cool place.

The obtained tabular silver iodobromide grains have the distribution coefficient of 15%, the mean diameter (of 10 the circle corresponding to the projected area) of 1.2 μm, the mean thickness of 0.18 μm and the silver iodide content of 5.7 mol %. The grains were observed using an electron microscope of 200 kv while cooling the grains with liquid nitrogen. As a result, 10 or more dislocation lines were observed at the edge of the tabular grains.

Emulsions 4-B to 4-E: comparative emulsions having a surface part doped with a hexa-coordinated cyano-complex (Comparison Example)

The procedure of the above-mentioned preparation of Emulsion 4-A was repeated except that 16.4 cc of $10^{-2}$M solution of $K_4[Fe(CN)_6]$, $K_4[Ru(CN)_6]$, $K_3[Co(CN)_6]$ or $K_3[Re(CN)_6]$ was added to the 0.5M silver nitrate solution used in the final double jet addition (shell formation).

Emulsions 4-F to 4-I: emulsions of the present invention having a surface part doped with a hexa-coordinated cyano-complex and containing a zinc compound The procedure of the above-mentioned preparation of Emulsions 4-B to 4-E was repeated except that 40 cc of an aqueous solution containing $8.5\times10^{-2}$M of $Zn(NO_3)_2$. $6H_{-2}O$ was added to the emulsion just before starting the final double jet addition (shell formation).

Emulsions 4-J to 4-M: emulsions of the present invention having a surface part doped with a hexa-coordinated cyano-complex and containing a caesium compound The procedure of the above-mentioned preparation of Emulsions 4-B to 4-E was repeated except that 60 cc of an aqueous solution containing $8.5\times10^{-2}$M of $CsNO_3$ was added to the emulsion just before starting the final double jet addition (shell formation).

Each of Emulsions 4-A to 4-M was subject to an optimum chemical sensitization at 60° C. using sodium thiosulfate, potassium chloroaurate and potassium thiocyanate.

Independently, after chemical sensitization, each of the emulsions was subject to spectral sensitization using 2.4× $10^{-4}$ mol/mol Ag of the following spectral sensitizing dye was added, and the resulting emulsion was left for 20 minutes at 40° C. so that the dye was adsorbed on the silver halide grains in the emulsion.

(Sensitizing dye)

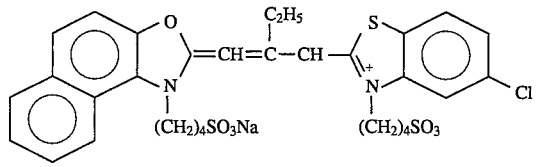

Preparation of coated samples

The following coupler ($1.5\times10^{-3}$ mol/m$^2$), tricresyl phosphate (1.10 g/m$^2$) and gelatin (2.30 g/m$^2$) were added to each of the obtained emulsions (silver: $3.6\times10^{-2}$ mol/m$^2$). The mixture was coated on a cellulose triacetate film support in the coating amounts set forth in the above brackets) to form an emulsion layer.

(Coupler)

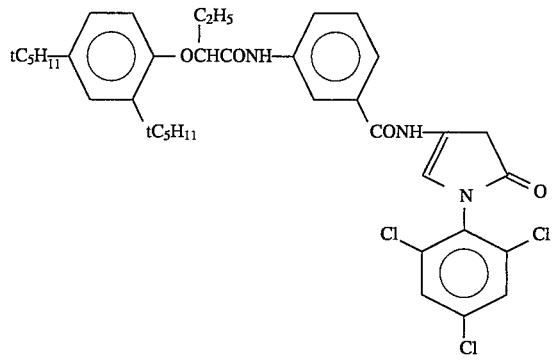

A protective layer containing sodium 2,4-dichloro-6-hydroxy-s-triazine (0.08 g/m$^2$) and gelatin (1.80 g/m$^2$) was coated on the emulsion layer to prepare a coated sample.

The coated sample was placed for 14 hours at the relative sensitivity of 70%. The samples was then exposed to light for 1/100 second through a yellow filter and a continuous wedge, and treated with the following color development.

| Process | Time | Temperature |
|---|---|---|
| Color development | 2 minutes | 40° C. |
| Bleach-fix | 3 minutes | 40° C. |
| Washing (1) | 20 seconds | 35° C. |
| Washing (2) | 20 seconds | 35° C. |
| Stabilizing | 20 seconds | 35° C. |
| Drying | 50 seconds | 65° C. |

The compositions of the processing solutions are shown below.

| | Amount |
|---|---|
| Color developing solution | |
| Diethylenetriamine tetraacetate | 2.0 g |
| Sodium 1-hydroxyethylidene-1,1-disulfonesulfite | 4.0 g |
| Potassium carbonate | 30.0 g |
| Potassium bromide | 1.4 g |
| Potassium iodide | 1.5 mg |
| Hydroxyaminesulfate | 2.4 g |
| 4-[N-ethyl-N-β-hydroxyethylamino]-2-methylaniline | 4.5 g |

-continued

| | Amount |
|---|---|
| sulfate | |
| Water (make up to) | 1,000 ml |
| pH | 10.05 |
| Bleach-fix solution | |
| Iron(II) ammonium dihydric salt of ethylenediamine tetraacetate | 90.0 g |
| Disodium ethylenediamine tetraacetate | 5.0 g |
| Sodium sulfite | 12.0 g |
| Aqueous solution of ammonium thiosulfate (70%) | 260.0 ml |
| Acetic acid (98%) | 5.0 ml |
| The following bleaching accelerator | 0.01 mol |
| Water (make up to) | 1,000 ml |
| pH | 6.0 |

(Bleaching accelerator)

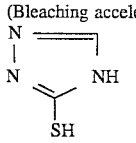

Washing solution

A running water was passed through a mixed bed column containing H type cation exchange resin (Amberlight IR-120B, Rome and Harth) and OH type anion exchange resin (Amberlight IR-400) to reduce the calcium and magnesium ions to not more than 3 mg per liter. Sodium dichloroisocyanurate (20 mg per liter) and sodium sulfate (1.5 g per liter) were added to the water. The pH of the washing water was in the range of 6.5 to 7.5.

| Stabilizing solution | Amount |
|---|---|
| Formalin (37%) | 2.0 ml |
| Polyoxyethylene-p-monophenylether (average polymerization degree: 10) | 0.3 g |
| Disodium ethylenediamine tetraacetate | 0.05 g |
| Water (make up to) liter | 1.0 |
| pH | 5 to 8 |

With respect to the developed color samples, (1) a spectral sensitivity, (2) a gradation and (3) a pressure reduction of the sensitivity were evaluated in the following manner.

(1) The spectral sensitivity was evaluated as a relative reciprocal value of the exposure giving the density of 0.1+ fog. The relative value is calculated based on that the result of the emulsion 4-A was 100. The larger value means the higher sensitivity.

(2) The gradation means a slope of a straight line portion in the characteristic curve. The larger slope means the higher contrast.

(3) The sample was placed for 3 hours at the relative humidity of 55%. In the atmosphere, the pressure of 4 g was applied to the sample by a needle of ϕ0.1 mm. Thus the sample was scratched with the needle at the speed of 1 cm per second. The sample was exposed to light for a sensitometry, and developed with the above-mentioned processing solutions. The color density of the developed sample was measured using a measurement slit of 5 μm×1 mm with respect to the pressured and not pressured parts. A pressure fog was observed at the unexposed part. A pressure reduction was observed at the highly exposed part. The degree of the pressure reduction was evaluated as a relative value, which is calculated based on that the value of the emulsion 4-A is 100. The smaller value means the smaller pressure reduction.

The results are set forth in Table 4.

TABLE 4

| No. | Dopant | Additive | (1) | (2) | (3) |
|---|---|---|---|---|---|
| 4-A | — | — | 100 | 1.6 | 100 |
| 4-B | $K_4[Fe(CN)_6]$ | — | 105 | 1.9 | 75 |
| 4-C | $K_4[Ru(CN)_6]$ | — | 110 | 1.8 | 80 |
| 4-D | $K_3[Co(CN)_6]$ | — | 105 | 1.7 | 80 |
| 4-E | $K_4[Re(CN)_6]$ | — | 105 | 1.8 | 85 |
| 4-F | $K_4[Fe(CN)_6]$ | $Zn^{2+}$ | 140 | 1.8 | 70 |
| 4-G | $K_4[Ru(CN)_6]$ | $Zn^{2+}$ | 140 | 1.7 | 65 |
| 4-H | $K_3[Co(CN)_6]$ | $Zn^{2+}$ | 130 | 1.7 | 70 |
| 4-I | $K_4[Re(CN)_6]$ | $Zn^{2+}$ | 130 | 1.6 | 80 |
| 4-J | $K_4[Fe(CN)_6]$ | $Cs^+$ | 135 | 1.8 | 70 |
| 4-K | $K_4[Ru(CN)_6]$ | $Cs^+$ | 140 | 1.7 | 65 |
| 4-L | $K_3[Co(CN)_6]$ | $Cs^+$ | 135 | 1.7 | 70 |
| 4-M | $K_4[Re(CN)_6]$ | $Cs^+$ | 130 | 1.6 | 80 |

As is evident from the Table 4, the doped emulsion 4-B to 4-E are improved with respect to the gradation and the pressure reduction of sensitivity, compared with the emulsion 4-A. However, the sensitivity is scarcely improved.

According to the present invention, the emulsions 4-F to 4-M are doped in the presence of the zinc or caesium compound. The emulsions of the present invention are improved in the sensitivity as well as the gradation and the pressure reduction. The zinc or caesium compound effectively prevents the formation of cyanogen caused by a reaction of the hexa-coordinated cyano-complex with gelatin used in the doped emulsion.

EXAMPLE 4

Emulsion 5-A: cubic silver chloride emulsion (Comparison Example)

To 3% aqueous solution of lime-treated gelatin, 3.3 g of sodium chloride and 24 ml of 1N sulfuric acid were added. To the mixture, an aqueous solution of 0.2 mol silver nitrate and an aqueous solution of 0.2 mol sodium chloride and 5 μmol rhodium trichloride were added while vigorously stirring at 75° C. After 5 minutes, the following sensitizing dye was added to the emulsion at 50° C. After minutes, a copolymer of monosodium isobutenemaleate was added to the emulsion. The emulsion was precipitated, washed with water, and desalted.

(Sensitizing dye)

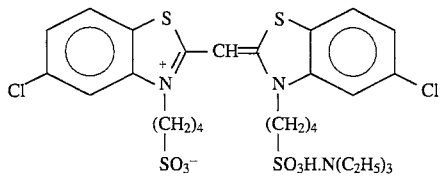

Further, 90.0 g of lime-treated gelatin was added to the emulsion. The emulsion was adjusted to pH 6.6 and pAg 7.2. Fine silver bromide grains (amount: 0.01 mol calculated as silver nitrate, grain size: 0.05 μm) and an aqueous solution of potassium salt of hexachloroiridium (IV) acid were added to the emulsion while vigorously stirring. The emulsion was subject to an optimum chemical sensitization at 50° C. using $1\times10^{-5}$ mol/mol Ag of a sulfur sensitizer, $1\times10^{-5}$ mol/mol Ag of chloroauric acid and 0.2 g/mol Ag of a nucleic acid. The obtained silver chlorobromide emulsion was observed with an electron microscope to determine the shape, size and distribution coefficient of the grains. The shape of the grain was cubic, the grain size was 0.75 μm, and the distribution coefficient was 0.08. The size was the average diameter of the circles corresponding to the projected areas of the grains. The distribution coefficient was calculated by dividing the standard deviation with the average grain size.

Emulsion 5-B: a comparative emulsion having a surface part doped with a hexa-coordinated cyano-complex The procedure of the above-mentioned preparation of Emulsion 5-A was repeated except that an aqueous solution of $K_4[Fe(CN)_6]$ was added to the emulsion according to a triple jet method simultaneously with the second addition of the silver nitrate and the halide solution to form a localized phase (concentration: $2\times10^{-4}$ mol/mol Ag) at the shell (30% of the grain). Thus a coped emulsion 5-B was prepared.

Emulsion 5-C: a emulsion of the present invention having a surface part doped with a hexa-coordinated cyano-complex and containing a zinc compound The procedure of the above-mentioned preparation of Emulsions 5-B was repeated except that 25 cc of 2% aqueous solution of $Zn(NO_3)_2$. $6H_2O$ was added to the emulsion with gelatin after desalting.

A color photographic paper (described in Example 1 of Japanese Patent Provisional Publication No. 5(1993)-113637) was prepared using the emulsion 5-A, 5-B or 5-C as a blue sensitive emulsion.

Each of the color paper samples was exposed to light through a step wedge using a sensitometer (FWH type, Fuji Photo Film Co., Ltd., color temperature: 3,200° K.). The amount of the exposure was adjusted to 250 CMS at 0.1 second exposure. The development was conducted according to a conventional color paper development process. The washing or stabilizing process was finished after 4 minutes of the development (as is described in Example 1 of Japanese Patent Provisional Publication No. 5(1993)-113637). The sensitivity and the fog was measured with respect to the obtained image. The results are set forth in Table 5.

TABLE 5

| Emulsion | Dopant | Zinc compound | Sensitivity | Fog |
|---|---|---|---|---|
| 5-A | — | — | 100 | 0.04 |
| 5-B | $K_4[Fe(CN)_6]$ | — | 60 | 0.04 |
| 5-C | $K_4[Fe(CN)_6]$ | Added | 150 | 0.04 |

EXAMPLE 5

Preparation of fine grain emulsion

A gelatin solution (water: 1,200 cc, gelatin: 2.4 g, average molecular weight of gelatin: 30,000, sodium chloride: 0.5 g, pH: 3.0) was placed in a reaction vessel. To the solution, a silver nitrate solution (silver nitrate: 0.2 g per cc, gelatin 0.01 g per cc, average molecular weight of gelatin: 30,000, 1N nitric acid: 0.25 cc/100 cc) and a sodium chloride solution (sodium chloride: 0.07 g per cc, gelatin: 0.01 g per cc, average molecular weight of gelatin: 30,000, 1N potassium hydroxide solution: 0.25 cc/100 cc) were simultaneously added for 3 minutes and 30 seconds at 23° C. while stirring at the feeding rate of 90 cc per minute. After the mixture was stirred for 1 minute, the emulsion was adjusted to pH 4.0 and pCl 1.7.

Emulsion 6-A: tabular silver chloride emulsion having a (100) plane (Comparison Example)

A gelatin solution (water: 1,200 cc, empty gelatin: 6 g, sodium chloride: 0.5 g, pH: 9.0) was placed in a reaction vessel. To the solution, a silver nitrate solution (silver nitrate: 0.1 g per cc) and a sodium chloride solution (sodium chloride: 10.0345 g per cc) were simultaneously added for 12 minutes at 65° C. while stirring at the feeding rate of 15 cc per minute. A gelatin solution (water: 100 cc, empty gelatin: 19 g, sodium chloride: 1.3 g) was added to the mixture. Further, 1N silver nitrate was added to the mixture to adjust pH of 4.0. The emulsion was heated to 70° C. and ripened for 15 minutes. To the emulsion, 0.15 mol of the fine grain emulsion was added. The mixture was ripened for 15 minutes. To the emulsion, 0.15 mol of the fine grain emulsion was again added. After 2 minutes of ripening, the emulsion was cooled to 45° C. The emulsion was adjusted to pH 5.2 using an aqueous sodium hydroxide solution. The sensitizing dye used in Example 4 and the following sensitizing dye (each of the amounts: $2\times10^{-4}$ mol per 1 mol of silver halide) were added to the emulsion. After 15 minutes of stirring, 0.01 mol of aqueous potassium bromide solution (potassium bromide: 1 g/100 cc) was added to the emulsion. The emulsion was further stirred for 5 minutes.

(Sensitizing dye)

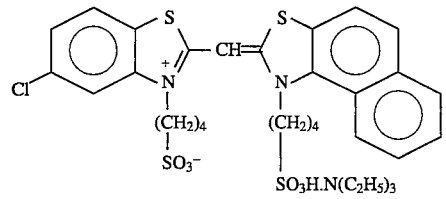

After a sedimentation agent was added to the emulsion, the emulsion was cooled to 27° C. The emulsion was adjusted to pH 4.0. The emulsion was washed with water according to a conventional sedimentation washing method. After a gelatin solution was added to the emulsion, the emulsion was adjusted pH 6.4 and pCl 2.8 at 40° C. The emulsion was heated to 55° C. The emulsion was subjected to an optimum chemical sensitization using sulfur, selenium and gold sensitizers.

The prepared silver halide emulsion was observed using an electron microscope. As a result, 80% of the total silver halide grains are tabular grains having a (100) main plate. The average grain size was 1.4 μm, the average aspect ratio was 6.5, and the average grain volume was 0.33 $\mu m^3$.

Emulsion 6-B: a comparative emulsion having a surface park doped with a hexa-coordinated cyano-complex (Comparison Example)

The procedure of the above-mentioned preparation of the fine grain emulsion was repeated except that $K_4[Fe(CN)_6]$ (0.125 mg per cc) was added to the sodium chloride solution.

In preparation of the emulsion 6-A, the fine grain emulsion of the emulsion 6-A was used at the first 4/5 stage of the addition, and then the above-prepared doped fine grain emulsion was used at the last 1/5 stage of the addition. Thus a tabular silver chloride emulsion (6-B) having a (100) plate doped with the cyano-complex at the shell of the grain was prepared.

Emulsion 6-C: an emulsion of the present invention having a surface part doped with a hexa-coordinated cyano-complex and containing a zinc compound The procedure of the above-mentioned preparation of Emulsion 6-B was repeated except that 20 cc of 2% aqueous solution of $Zn(NO_3)_2$. $6H_2O$ was added to the emulsion with gelatin after washing the emulsion with water.

A color photographic paper (described in Example 1 of Japanese Patent Provisional Publication No. 5(1993)-113637) was prepared using the emulsion 6-A, 6-B or 6-C as a green sensitive emulsion.

Each of the color paper samples was exposed to light through a step wedge using a sensitometer (FWH type, Fuji Photo Film Co., Ltd., color temperature: 3,200° K.). The amount of the exposure was adjusted to 250 CMS at 0.1 second exposure. The development was conducted according to a conventional color paper development process. The washing or stabilizing process was finished after 4 minutes of the development (as is described in Example 1 of Japanese Patent Provisional Publication No. 5(1993)-113637).

The sensitivity and the fog was measured with respect to the obtained image. The results are set forth in Table 6.

TABLE 6

| Emulsion | Dopant | Zinc compound | Sensitivity | Fog |
|---|---|---|---|---|
| 6-A | — | — | 100 | 0.05 |
| 6-B | $K_4[Fe(CN)_6]$ | — | 55 | 0.05 |
| 6-C | $K_4[Fe(CN)_6]$ | Added | 140 | 0.05 |

As is shown in the results of Table 6, the emulsion 6-C using a zinc compound of the present invention shows a high sensitivity.

Further, the emulsion 6-C shows the highest gradation in the obtained image. Further, the samples were stored for 5 days at 50° C. to examine the preservability. As a result, the increase of the fog was scarcely observed in the emulsions 6-C and 6-B, compared with the emulsion 6-A.

EXAMPLE 6

Emulsion 7-A: tabular silver chloride emulsion having a (111) plane (Comparison Example)

The following solutions (1) to (5) were prepared.

| Solution | Component | Water (make up to) |
|---|---|---|
| (1) | Lime-treated bone gelatin: 30 g<br>Sodium chloride: 11 g | 1,000 cc |
| (2) | Silver nitrate: 11 g | 200 cc |
| (3) | Sodium chloride: 4.5 g | 200 cc |
| (4) | silver nitrate: 90 g | 600 cc |
| (5) | Sodium chloride: 42 g | 600 cc |

To the solution (1), 0.5 g of the following compound was added while vigorously stirring. The solutions (2) and (3) were simultaneously added to the mixture for 3 minutes. Further, the solutions (4) and (5) were simultaneously added for 20 minutes. The emulsion was washed with water and desalted according to a conventional flocculation method. To the emulsion, 40 g of lime-treated bone gelatin and 300 cc of water were added. The emulsion was adjusted to pH 6.4 and pAg 7.5 at 40° C. The emulsion was heated to 55° C. and subjected to an optimum chemical sensitization using sulfur, selenium and gold sensitizers.

(Compound)

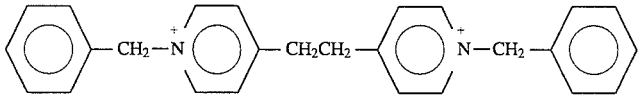

2Cl.

Emulsion 7-B: a comparative tabular silver chloride emulsion doped with a hexa-coordinated cyano-complex (Comparison Example).

The procedure of the above-mentioned preparation of the emulsion 7-A was repeated except that the following solution (6) was added to the emulsion at the last 3 minutes stage of the addition of the solutions (4) and (5). Thus a tabular silver chloride emulsion (7-B) having a surface part doped with the cyano-complex at the shell of the grain was prepared.

| Solution | Component | Water (make up to) |
|---|---|---|
| (6) | $K_4[Fe(CN)_6]$: 33 mg | 90 cc |

Emulsion 7-C: an emulsion of the present invention having a surface part doped with a hexa-coordinated cyano-complex and containing a zinc compound The procedure of the above-mentioned preparation of Emulsion 7-B was repeated except that 20 cc of 2% aqueous solution of $Zn(NO_3)_2 \cdot 6H_2O$ was added to the emulsion with gelatin after washing the emulsion with water.

To each of the emulsions 7-A, 7-B and 7-C, $8\times10^{-4}$ mol/mol Ag of KSCN was added. Further, $2\times10^{-4}$ mol/mol Ag of the sensitizing dye used in Example 3 was added to the emulsion. The emulsion was left for 20 minutes at 45° C. so that the sensitizing dye was adsorbed on the grains.

Coated samples were prepared in the same manner as in Example 3 using the emulsions. The samples were processed in the same manner as in Example 3. The photographic property was then evaluated. The results are set forth in Table 7.

TABLE 7

| Emulsion | Dopant | Zinc compound | Sensitivity | Fog |
|---|---|---|---|---|
| 7-A | — | — | 100 | 0.13 |
| 7-B | $K_4[Fe(CN)_6]$ | — | 55 | 0.12 |
| 7-C | $K_4[Fe(CN)_6]$ | Added | 170 | 0.14 |

As is shown in the results of Table 7, the emulsion 7-C using a zinc compound of the present invention shows a high sensitivity.

Further, the emulsion 7-C shows the highest gradation in the obtained image. Further, the samples were stored for 5 days at 50° C. to examine the preservability. As a result, the increase of the fog was scarcely observed in the emulsions 7-C and 7-B, compared with the emulsion 7-A.

EXAMPLE 7

Preparation of various silver halide emulsions

The silver halide emulsions set forth in Table 8 were prepared. In Table 8, the column (1 ) show the average grain size, the column (2) shows the distribution coefficient, and the column (3) shows the AgI content.

TABLE 8

| No. | Shape of grains | (1) (μm) | (2) (%) | (3) (%) |
|---|---|---|---|---|
| A | Monodispersed tetradecahedron | 0.35 | 16 | 4.0 |
| B | Monodispersed cube (internal) | 0.45 | 10 | 2.0 |

TABLE 8-continued

| No. | Shape of grains | (1) (μm) | (2) (%) | (3) (%) |
|---|---|---|---|---|
| C | Polydispersed twin (core/shell) | 0.80 | 27 | 6.0 |
| D | Polydispersed twin | 1.10 | 25 | 6.0 |
| E | Polydispersed twin | 0.30 | 26 | 6.5 |
| F | Polydispersed twin | 0.40 | 23 | 5.5 |
| G | Monodispersed cube (internal) | 0.50 | 11 | 4.5 |
| H | Monodispersed tabular shape (2.8) | 0.80 | 15 | 5.0 |
| I | Monodispersed tabular shape (6.7) | 1.20 | 15 | 5.0 |
| J | Polydispersed tabular shape (5.0) | 0.60 | 28 | 3.5 |
| K | Monodispersed tabular shape (4.3) | 0.70 | 15 | 5.0 |
| L | Monodispersed octahedron | 0.80 | 14 | 5.0 |
| M | Monodispersed tabular shape (7.8) | 1.00 | 18 | 5.0 |
| N | Polydispersed twin (core/shell) | 1.70 | 27 | 7.5 |

TABLE 8-continued

| No. | Shape of grains | (1) (μm) | (2) (%) | (3) (%) |
|---|---|---|---|---|

Remark:
internal = internal latent image type
core/shell = core/shell grain having a high iodide content in the core
value in the parentheses of the tabular shape aspect ratio The emulsions 4-A, 4-B, 4-C, 4-F and 4-G prepared in Example 3 were used as the above-mentioned emulsion I. Sensitizing dyes were added to each of the emulsions as is set forth in Table 9. In Table 9, the values mean the amounts of the sensitizing dyes (g) based on 1 mol of silver halide.

TABLE 9

| | Sensitizing dyes (S-) | | | | | | | | | |
|---|---|---|---|---|---|---|---|---|---|---|
| | 1 | 2 | 3 | 4 | 5 | 6 | 7 | 8 | 9 | 10 |
| A | 0.15 | 0.02 | — | — | — | — | — | — | 0.15 | — |
| B | 0.15 | 0.04 | — | — | — | — | — | — | 0.20 | — |
| C | 0.15 | 0.02 | — | — | — | — | — | — | 0.05 | — |
| D | 0.08 | 0.01 | — | — | — | — | — | — | 0.02 | — |
| E | — | — | 0.05 | 0.08 | — | — | 0.02 | — | — | 0.05 |
| F | — | — | 0.30 | 0.07 | — | — | 0.03 | — | — | — |
| G | — | — | 0.25 | 0.08 | — | — | — | — | — | — |
| H | — | — | 0.20 | 0.03 | — | — | 0.03 | — | — | 0.10 |
| I | — | — | 0.30 | 0.02 | — | — | 0.02 | 0.10 | — | 0.05 |
| J | — | — | — | — | 0.20 | 0.05 | — | — | — | — |
| K | — | — | — | — | 0.20 | 0.05 | — | — | — | — |
| L | — | — | — | — | 0.22 | 0.06 | — | — | — | — |
| M | — | — | — | — | 0.15 | 0.04 | — | — | — | — |
| N | | — | — | — | 0.22 | 0.06 | — | — | — | — |

(S-1)

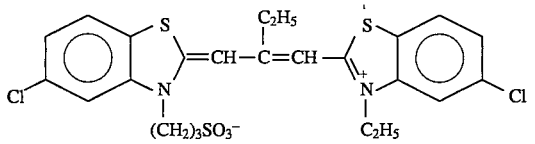

(S-2)

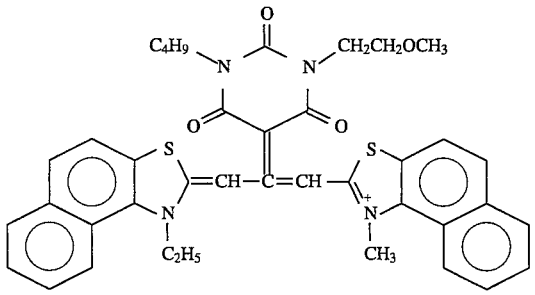

(S-3)

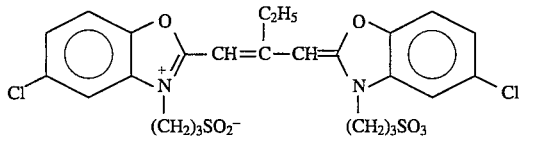

(S-4)

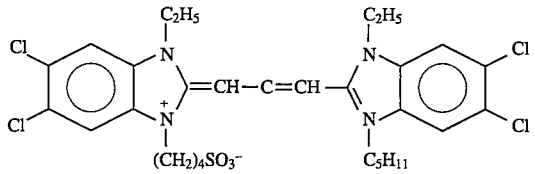

TABLE 9-continued

| Sensitizing dyes (S-) | | | | | | | | | |
|---|---|---|---|---|---|---|---|---|---|
| 1 | 2 | 3 | 4 | 5 | 6 | 7 | 8 | 9 | 10 |

(S-5)

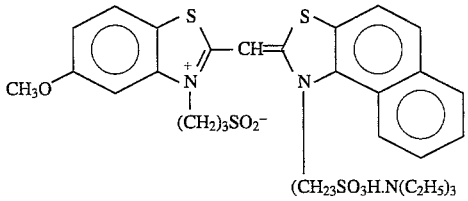

(S-6)

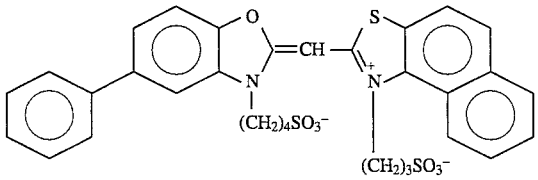

(S-7)

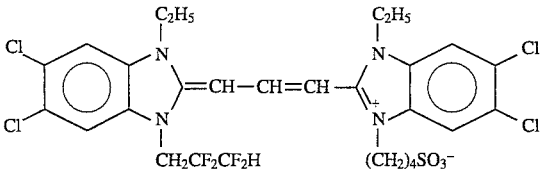

(S-8)

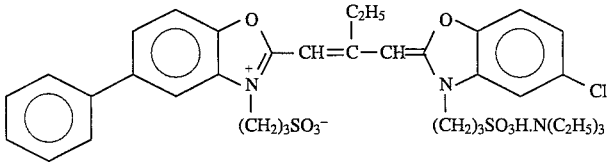

(S-9)

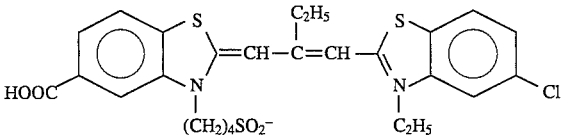

(S-10)

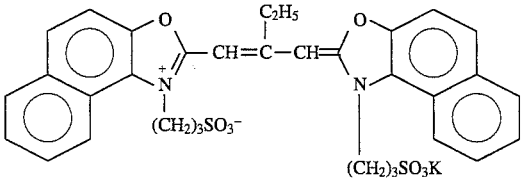

Preparation of color photographic material

A cellulose triacetate film (thickness: 205 μm) having undercoating layers on the both sides was used as the support. On the support, the following layers were coated to prepare a multi-layered color photographic material. The coating amounts shown below are based on 1 $m^2$ of the sample, except that the amounts of the silver halide and the colloidal silver mean the weight of contained silver.

| First layer (antihalation layer) | |
|---|---|
| Black colloidal silver | 0.25 g |
| Gelatin | 0.9 g |
| Ultraviolet absorbent U-1 | 0.2 g |
| Ultraviolet absorbent U-3 | 0.1 g |
| Ultraviolet absorbent U-4 | 0.2 g |
| High boiling organic solvent Oil-1 | 0.1 g |
| Fine crystal dispersion of dye E-1 | 0.1 g |

-continued

| Second layer (intermediate layer) | |
|---|---|
| Non-light-sensitive fine grain silver iodobromide emulsion (average grain size: 0.1 μm, AgI content: 1 mol %) (silver amount) | 0.15 g |
| Fine grain silver iodobromide emulsion wherein both surface and internal parts are fogged (average grain size: 0.06 μm, distribution coefficient: 18%, AgI content: 1 mol %) (silver amount) | 0.05 g |
| Compound Cpd-A | 0.1 g |
| Compound Cpd-M | 0.05 g |
| Gelatin | 0.4 g |
| **Third layer (intermediate layer)** | |
| Gelatin | 0.40 g |
| Compound Cpd-C | 1 mg |
| Compound Cpd-D | 3 mg |
| Dye D-4 | 0.4 mg |
| High boiling organic solvent Oil-3 | 40 mg |

| | |
|---|---|
| Fourth layer (low red sensitive emulsion layer) | |
| Emulsion A (silver amount) | 0.3 g |
| Emulsion B (silver amount) | 0.4 g |
| Gelatin | 0.8 g |
| Coupler C-1 | 0.09 g |
| Coupler C-2 | 0.03 g |
| Coupler C-3 | 0.02 g |
| Coupler C-10 | 0.02 g |
| Compound Cpd-10 | 1 mg |
| Compound Cpd-K | 0.05 g |
| High boiling organic solvent Oil-2 | 0.10 g |
| Latex dispersion of ethyl acrylate | 0.5 g |
| Fifth layer (middle red sensitive emulsion layer) | |
| Emulsion B (silver amount) | 0.2 g |
| Emulsion C (silver amount) | 0.3 g |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| Latex dispersion of ethyl acrylate | 0.05 g |
| Sixth layer (high red sensitive emulsion layer) | |
| Emulsion D (silver amount) | 0.4 g |
| Gelatin | 1.1 g |
| Coupler C-1 | 0.3 g |
| Coupler C-2 | 0.01 g |
| Coupler C-3 | 0.1 g |
| Additive P-1 | 0.02 g |
| Latex dispersion of ethyl acrylate | 0.1 g |
| Seventh layer (intermediate layer) | |
| Gelatin | 1.0 g |
| Compound Cpd-J | 0.2 g |
| Compound Cpd-L | 0.05 g |
| Compound Cpd-N | 0.02 g |
| Additive P-1 | 0.05 g |
| Dye D-1 | 0.02 g |
| Eighth layer (intermediate layer) | |
| Silver iodobromide emulsion wherein both surface and internal parts are fogged (average grain size: 0.06 μm, distribution coefficient: 16%, AgI content: 0.3 mol %) (silver amount) | 0.02 g |
| Gelatin | 0.4 g |
| Compound Cpd-A | 0.1 g |
| Compound Cpd-D | 1 mg |
| Compound Cpd-M | 0.05 g |
| Ninth layer (low green sensitive emulsion layer) | |
| Silver iodobromide emulsion wherein the internal part is fogged (average grain size: 0.1 μm, AgI content: 0.1 mol %) (silver amount) | 0.15 g |
| Emulsion E (silver amount) | 0.3 g |
| Emulsion F (silver amount) | 0.1 g |
| Emulsion G (silver amount) | 0.1 g |
| Gelatin | 2.0 g |
| Coupler C-4 | 0.03 g |
| Coupler C-7 | 0.05 g |
| Coupler C-8 | 0.02 g |
| Coupler C-9 | 0.05 g |
| Coupler C-12 | 0.2 g |
| Compound Cpd-B | 0.03 g |
| Compound Cpd-D | 1 mg |
| Compound Cpd-E | 0.02 g |
| Compound Cpd-F | 0.02 g |
| Compound Cpd-G | 0.02 g |
| Compound Cpd-H | 0.02 g |
| High boiling organic solvent Oil-2 | 0.2 g |
| Tenth layer (Middle green sensitive emulsion layer) | |
| Emulsion G (silver amount) | 0.3 g |
| Emulsion H (silver amount) | 0.1 g |
| Gelatin | 0.6 g |
| Coupler C-4 | 0.1 g |
| Coupler C-7 | 0.05 g |
| Coupler C-8 | 0.05 g |
| Coupler C-9 | 0.02 g |

| | |
|---|---|
| Coupler C-12 | 0.20 g |
| Compound Cpd-B | 0.03 g |
| Compound Cpd-E | 0.02 g |
| Compound Cpd-F | 0.02 g |
| Compound Cpd-G | 0.05 g |
| Additive F-5 | 0.08 mg |
| High boiling organic solvent Oil-2 | 0.01 g |
| Eleventh layer (high green sensitive emulsion layer) | |
| Silver iodobromide emulsion wherein the internal part is fogged (average grain size: 0.2 μm, AgI content: 0.1 mol %) (silver amount) | 0.05 g |
| Emulsion I (silver amount) | 0.5 g |
| Gelatin | 1.1 g |
| Coupler C-4 | 0.1 g |
| Coupler C-7 | 0.3 g |
| Coupler C-8 | 0.07 g |
| Coupler C-9 | 0.05 g |
| Coupler C-12 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High boiling organic solvent Oil-2 | 0.04 g |
| Twelfth layer (intermediate layer) | |
| Gelatin | 0.4 g |
| Latex dispersion of ethyl acrylate | 0.15 g |
| Dye D-1 | 0.1 g |
| Dye D-2 | 0.05 g |
| Dye D-3 | 0.07 g |
| Thirteenth layer (yellow filter layer) | |
| Yellow colloidal silver (silver amount) | 0.08 g |
| Gelatin | 1.0 g |
| Compound Cpd-A | 0.04 g |
| High boiling organic solvent Oil-1 | 0.01 g |
| Crystal dispersion of dye E-2 | 0.05 g |
| Fourteenth layer (intermediate layer) | |
| Gelatin | 0.6 g |
| Fifteenth layer (low blue sensitive emulsion layer) | |
| Silver iodobromide emulsion wherein the internal part is fogged (average grain size: 0.2 μm, AgI content: 0.1 mol %) (silver amount) | 0.1 g |
| Emulsion J (silver amount) | 0.4 g |
| Emulsion K (silver amount) | 0.1 g |
| Emulsion L (silver amount) | 0.1 g |
| Gelatin | 1.0 g |
| Coupler C-5 | 0.5 g |
| Coupler C-6 | 0.1 g |
| Coupler C-11 | 0.1 g |
| Compound Cpd-K | 0.1 g |
| Sixteenth layer (middle blue sensitive emulsion layer) | |
| Emulsion L (silver amount) | 0.1 g |
| Emulsion M (silver amount) | 0.1 g |
| Gelatin | 0.6 g |
| Coupler C-5 | 0.02 g |
| Coupler C-6 | 0.002 g |
| Coupler C-11 | 0.02 g |
| Seventeenth layer (high blue sensitive emulsion layer) | |
| Emulsion N (silver amount) | 0.6 g |
| Gelatin | 1.4 g |
| Coupler C-5 | 0.05 g |
| Coupler C-6 | 0.08 g |
| Coupler C-11 | 0.8 g |
| Eighteenth layer (first protective layer) | |
| Gelatin | 0.9 g |
| Ultraviolet absorbent U-1 | 0.1 g |
| Ultraviolet absorbent U-2 | 0.01 g |
| Ultraviolet absorbent U-3 | 0.03 g |
| Ultraviolet absorbent U-4 | 0.03 g |
| Ultraviolet absorbent U-5 | 0.05 g |
| Ultraviolet absorbent U-6 | 0.05 g |
| High boiling organic solvent Oil-1 | 0.02 g |

-continued

| | |
|---|---|
| Formalin scavenger Cpd-C | 0.2 g |
| Formalin scavenger Cpd-I | 0.4 g |
| Latex dispersion of ethyl acrylate | 0.05 g |
| Dye D-3 | 0.05 g |
| Compound Cpd-A | 0.02 g |
| Compound Cpd-J | 0.02 g |
| Compound Cpd-N | 0.01 g |
| Nineteenth layer (second protective layer) | |
| Colloidal silver (silver amount) | 0.05 mg |
| Fine grain silver iodobromide emulsion (average grain size: 0.06 μm, AgI content: 1 mol %) (silver amount) | 0.05 g |
| Gelatin | 0.3 g |
| Twentieth layer (third protective layer) | |
| Colloidal silver (silver amount) | 0.05 mg |
| Fine grain silver iodobromide emulsion (average grain size: 0.07 μm, AgI content: 1 mol %) (silver amount) | |
| Gelatin | 0.6 g |

-continued

| | |
|---|---|
| Polymethyl methacrylate (average particle size: 1.5 μm) | 0.1 g |
| Copolymer of methyl methacrylate and acrylic acid (copolymerization ratio = 4:6, average particle size: 1.5 μm) | 0.1 g |
| Surface active agent W-1 | 3.0 mg |
| Surface active agent W-2 | 0.03 mg |

The additives F-1 to F-9 were added to the silver halide emulsion layers and the intermediate layers.

Further, the hardening agent H-1, the coating surface active agents W-3, W-4 and W-5 and the emulsifying surface active agent for W-6 were added to each of the layers.

Furthermore, phenol, 1,2-benzisothiazoline-3-one, 2-phenoxyethanol, phenyl isothiocyanate and phenethyl alcohol were added to each of the layers as a preservative.

The used compounds are shown below.

(C-1)

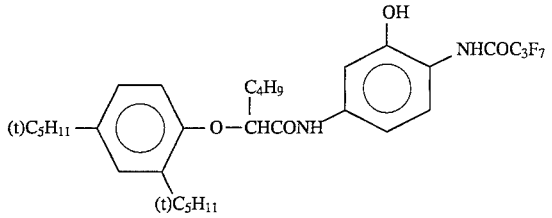

(C-2)

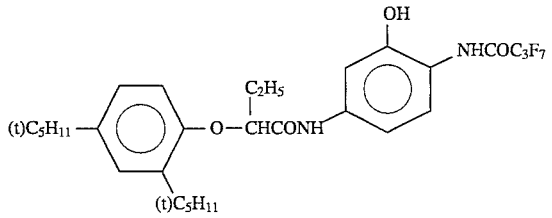

(C-3)

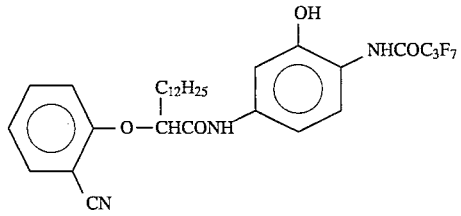

(C-4)

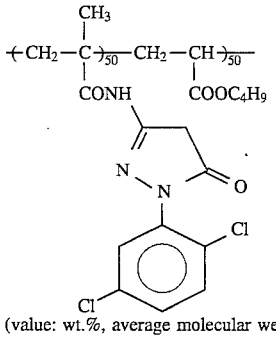

(value: wt.%, average molecular weight: about 25,000)

-continued
(C-5)
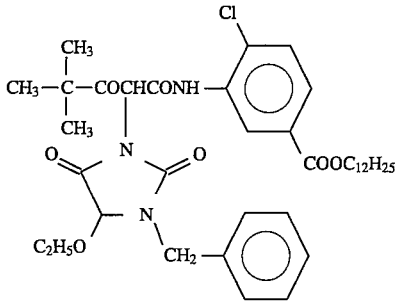
(C-6)
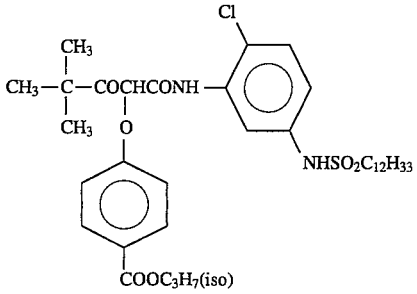
(C-7)
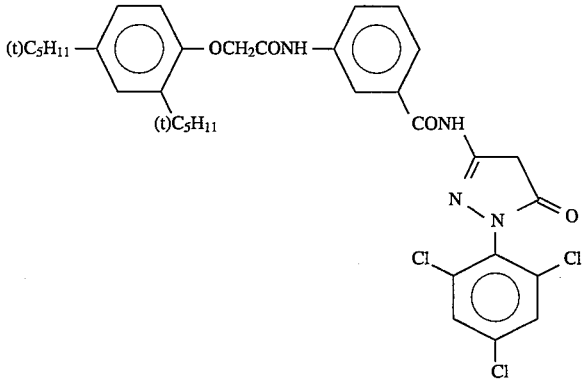
(C-8)
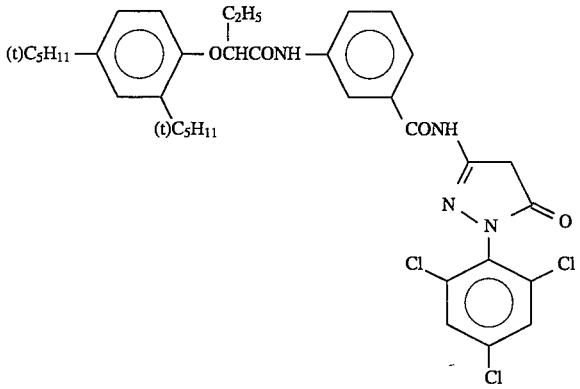
(C-9)
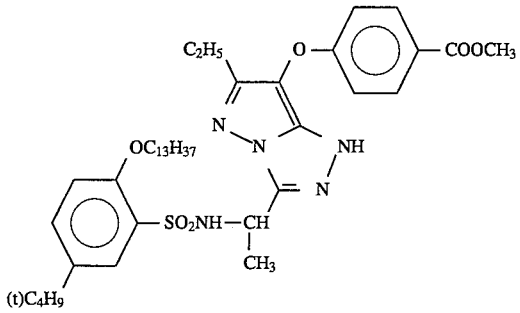

-continued
(C-10)
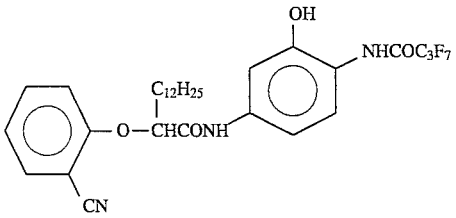
(C-11)
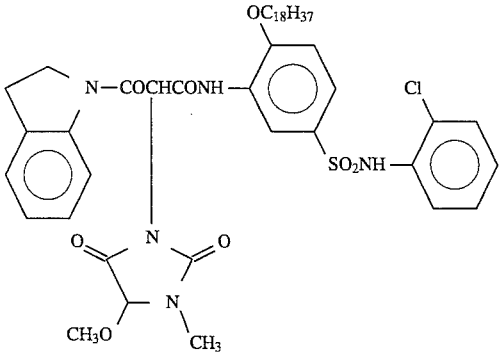
(C-12)
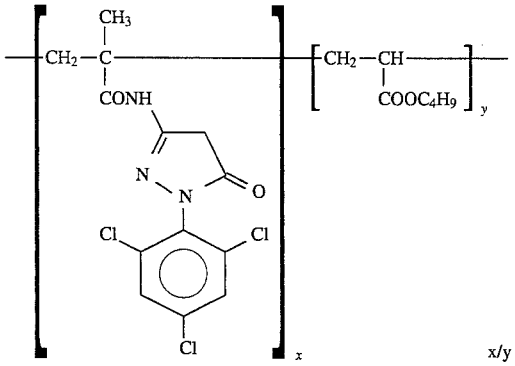
x/y = 1
Dibutyl phthalate (Oil-1)
Tricresyl phosphate (Oil-2)
(Oil-3)
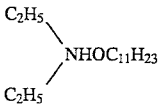
(Cpd-A)
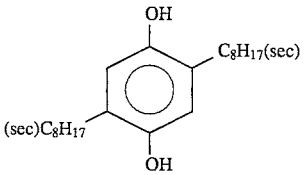
(Cpd-B)
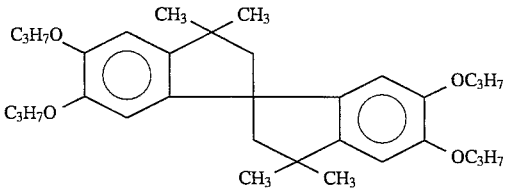
(Cpd-C)
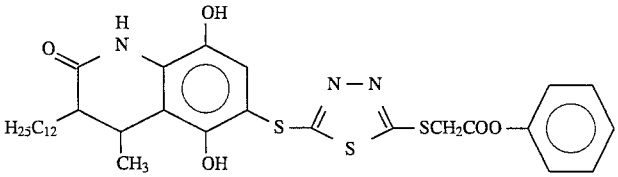

-continued
(Cpd-D)
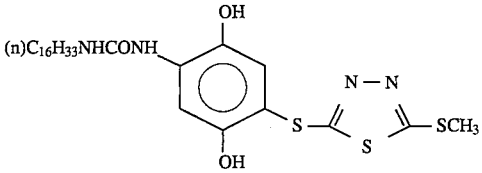
(Cpd-E)
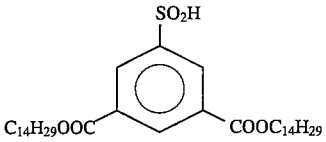
(Cpd-F)
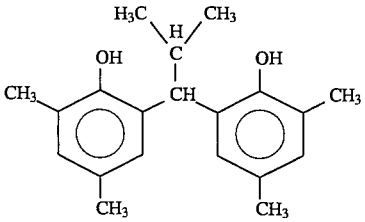
(Cpd-G)
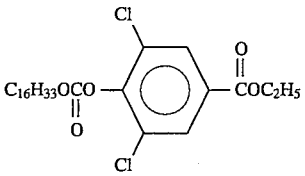
(Cpd-H)
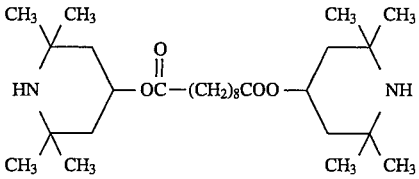
(Cpd-I)
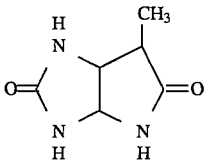
(Cpd-J)
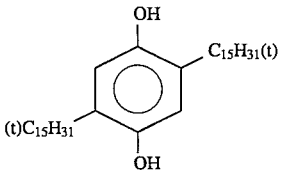
(Cpd-K)
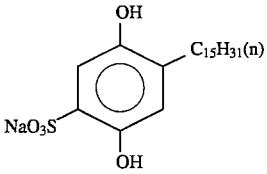
(Cpd-L)
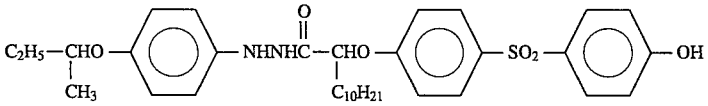

-continued
(Cpd-M)
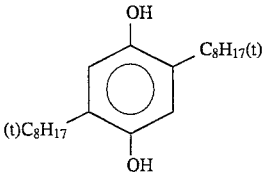
(Cpd-N)
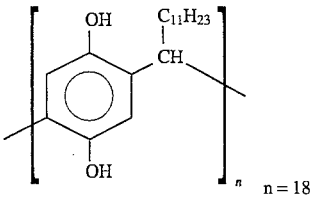
(U-1)
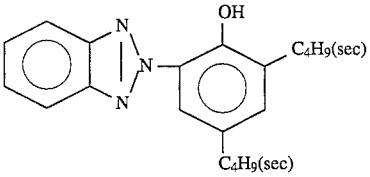
(U-2)
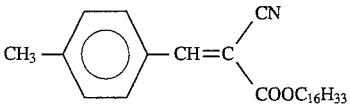
(U-3)
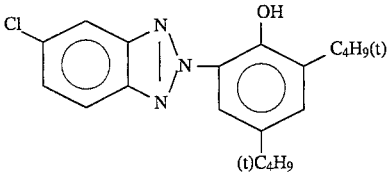
(U-4)
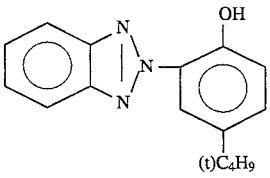
(U-5)
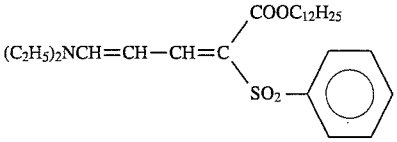
(U-6)
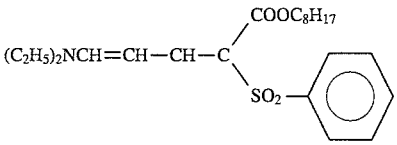
(D-1)
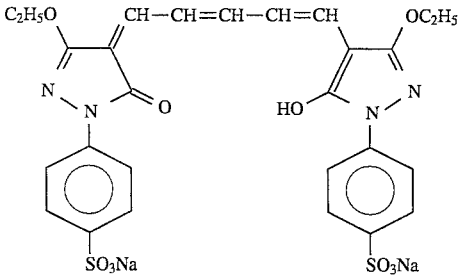

-continued
(D-2)
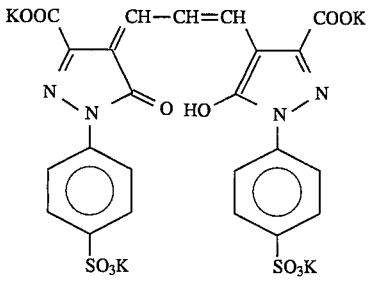
(D-3)
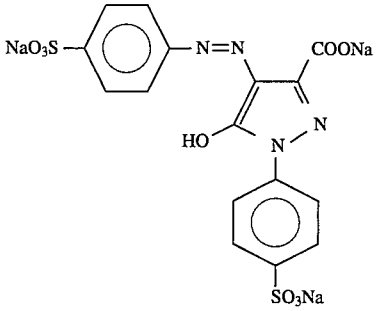
(D-4)
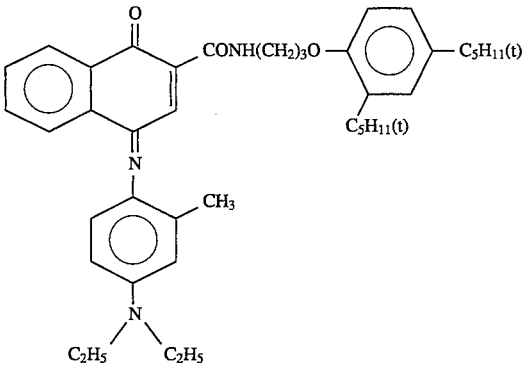
(E-1)
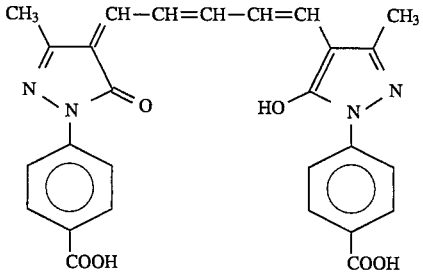
(E-2)
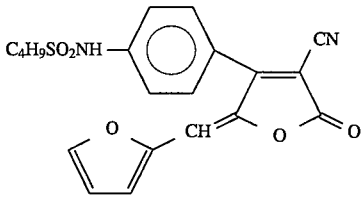
(H-1)
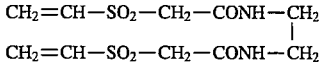
(W-1)
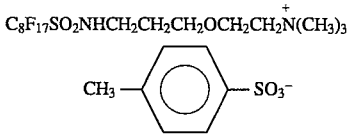

-continued
$C_8F_{17}SO_{32}NCH_2COOK$ (W-2)
$C_3H_7$
$CH_2COOCH_2CH(C_2H_5)C_4H_9$ (W-3)
$NaO_3S-CHCOOCH_2CH(C_2H_5)C_4H_9$
(W-4)
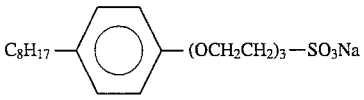
(W-5)
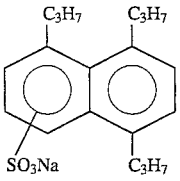
(W-6)
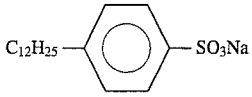
$-(CH_2-CH)_n-$ (P-1)
$CONHC_4H_9(t)$
(F-1)
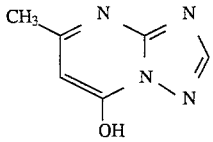
(F-2)
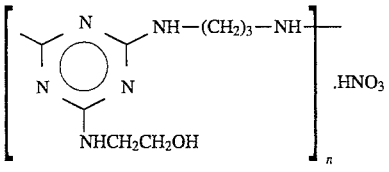
n = 3–4
(F-3)
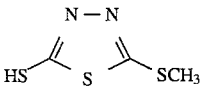
(F-4)
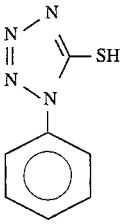
(F-5)
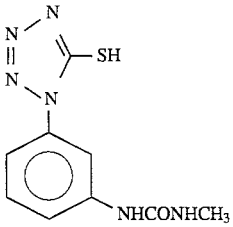
(F-6)
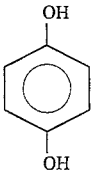

-continued

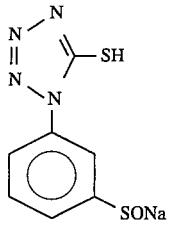

(F-7)

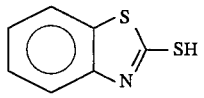

(F-8)

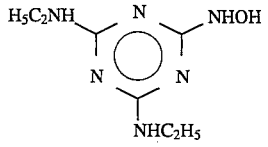

(F-9)

Color reversal development

The prepared sample was exposed to light through an optical edge, and was subject to a color reversal development under the following conditions.

| Process | Time | Temperature | Tank Volume | Amount of Replenisher |
|---|---|---|---|---|
| B & W develop. | 6 minutes | 38° C. | 12 liter | 2.2 liter/$m^2$ |
| 1st washing | 2 minutes | 38° C. | 4 liter | 7.5 liter/$m^2$ |
| Reversal | 2 minutes | 38° C. | 4 liter | 1.1 liter/$m^2$ |
| Color develop. | 6 minutes | 38° C. | 12 liter | 2.2 liter/$m^2$ |
| Adjustment | 2 minutes | 38° C. | 4 liter | 1.1 liter/$m^2$ |
| Bleaching | 6 minutes | 38° C. | 12 liter | 0.22 liter/$m^2$ |
| Fixing | 4 minutes | 38° C. | 8 liter | 1.1 liter/$m^2$ |
| 2nd Washing | 4 minutes | 38° C. | 8 liter | 7.5 liter/$m^2$ |
| Stabilizing | 1 minutes | 38° C. | 4 liter | 1.2 liter/$m^2$ |

The compositions of the processing solutions are shown below.

| Black and white developing solution | Mother liquid | Replenisher |
|---|---|---|
| Pentasodium nitrilo-N,N,N-trimethylene-phosphonate | 2.0 g | 2.0 g |
| Sodium sulfite | 30 g | 30 g |
| Potassium hydroquinonemonosulfonate | 20 g | 20 g |
| Potassium carbonate | 33 g | 33 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.1 g | 1.2 g |
| Potassium iodide | 2.0 mg | — |
| Water (make up to) | 1,000 ml | 1,000 ml |
| pH (adjusted by hydrochloric acid or potassium hydroxide) | 9.60 | 9.60 |

| Reversal solution | Mother liquid and Replenisher |
|---|---|
| Pentasodium nitrilo-N,N,N-trimethylene-phosphonate | 3.0 g |
| Dihydric salt of stannic chloride | 1.0 g |
| p-Aminophenol | 0.1 g |
| Sodium hydroxide | 8 g |
| Glacial acetic acid | 15 ml |
| Water (make up to) | 1,000 ml |
| pH (adjusted by hydrochloric acid or potassium hydroxide) | 6.00 |

-continued

| Color developing solution | Mother liquid | Replenisher |
|---|---|---|
| Pentasodium nitrilo-N,N,N-trimethylene-phosphonate | 2.0 g | 2.0 g |
| Sodium sulfite | 30 g | 30 g |
| Trisodium phosphate 12 hydric salt | 36 g | 36 g |
| Potassium bromide | 1.0 g | — |
| Potassium iodide | 90 mg | — |
| Sodium hydroxide | 3.0 g | 3.0 g |
| Citrazic acid | 1.5 g | 1.5 g |
| N-ethyl-N-β-methanesulfoamidoethyl)-3-methyl-4-aminoaniline sulfate | 11 g | 11 g |
| 3,6-Dithia-1,8-octanediol | 1.0 g | 1.0 g |
| Water (make up to) | 1,000 ml | 1,000 ml |
| pH (adjusted by hydrochloric acid or potassium hydroxide) | 11.80 | 12.00 |

| Adjusting solution | Mother liquid and Replenisher |
|---|---|
| Dihydric salt of disodium ethylenediamine tetraacetic acid | 8.0 g |
| Sodium sulfite | 12 g |
| 1-Thioglycerin | 0.4 ml |
| Sorbitan ester | 0.1 g |
| Water (make up to) | 1,000 ml |
| pH (adjusted by hydrochloric acid or potassium hydroxide) | 6.20 |

| Bleaching solution | Mother liquid | Replenisher |
|---|---|---|
| Dihydric salt of disodium ethylenediamine tetraacetic acid | 2.0 g | 4.0 g |
| Dihydric salt of FE(III) ammonium ethylenediamine tetraacetic acid | 120 g | 240 g |
| Potassium bromide | 100 g | 200 g |
| Ammonium nitrate | 10 g | 20 g |
| Water (make up to) | 1,000 ml | 1,000 ml |
| pH (adjusted by hydrochloric acid or potassium hydroxide) | 5.70 | 5.50 |

| Fixing solution | Mother liquid and Replenisher |
|---|---|
| Ammonium thiosulfate | 8.0 g |
| Sodium sulfite | 5.0 g |
| Sodium bisulfite | 5.0 g |
| Water (make up to) | 1,000 ml |
| pH (adjusted by hydrochloric acid or ammonia water) | 6.60 |

-continued

| Stabilizing solution | Mother liquid and Replenisher |
|---|---|
| Formalin | 5.0 ml |
| Polyoxyethylene-p-mononolylphenylether (average polymerization degree: 10) | |
| water (make up to) | 1,000 ml |
| pH (not adjusted) | |

The green sensitivity of the obtained color image was evaluated. The green sensitivity was measured at the density of 2.5. Accordingly, the measured sensitivity corresponds to the sensitivity of the high green sensitive emulsion layer. The fog values of the samples were the same. The results are set forth in Table 10.

TABLE 10

| Emulsion | Dopant | Zinc compound | Sensitivity |
|---|---|---|---|
| 4-A | — | — | 100 |
| 4-B | $K_4[Fe(CN)_6]$ | — | 60 |
| 4-C | $K_4[Ru(CN)_6]$ | — | 55 |
| 4-F | $K_4[Fe(CN)_6]$ | $Zn(NO_3)_2.6H_2O$ | 120 |
| 4-G | $K_4[Ru(CN)_6]$ | $Zn(NO_3)_2.6H_2O$ | 125 |

It is apparent from the results shown in Table 10 that the emulsions 4-F and 4-G prepared according to the present invention show a high sensitivity.

EXAMPLE 8

Emulsion 8-A: tabular silver chloride emulsion having a (111) plane (Comparison Example)

The solutions (1) to (5) used in Example 6 were prepared.

To the solution (1), 0.5 g of the compound used in Example 6 was added while vigorously stirring. The solutions (2) and (3) were simultaneously added to the mixture for 3 minutes. Further, the solutions (4) and (5) were simultaneously added for 20 minutes. After 1 minute, 0.012 mol of fine grain silver chloride emulsion used in Example 5 was added to the mixture. The resulting emulsion was ripened at 60° C. for 7 minutes. The emulsion was washed with water and desalted according to a conventional flocculation method. To the emulsion, 40 g of lime-treated bone gelatin and 300 cc of water were added. The emulsion was adjusted to pH 6.4 and pAg 7.5 at 40° C. The emulsion was heated to 55° C., and subjected to an optimum chemical sensitization using sulfur, selenium and gold sensitizers.

Emulsion 8-B: a comparative tabular silver chloride emulsion doped with a hexa-coordinated cyano-complex (Comparison Example)

The procedure of the preparation of the fine grain emulsion used in Example 5 was repeated except that $K_4[Fe(CN)_6]$ ($10^3$ mol per 1 mol of silver halide) was added to the sodium chloride solution to prepare the fine grain emulsion. A silver halide emulsion was prepared in the same manner as in the preparation of the emulsion 8-A, except that the above-prepared fine grain emulsion was used. Thus a tabular silver chloride emulsion (8-B) having a surface part doped with the cyano-complex ($10^{-3}$ mol per 1 mol of silver halide) at the shell of the grain was prepared.

Emulsions 8-C to 8-E: emulsions of the present invention having a surface part doped with a hexa-coordinated cyano-complex and containing additive compounds The procedure of the above-mentioned preparation of Emulsion 8-B was repeated except that each of the compounds shown in Table 11, 40 g of lime-treated bone gelatin and water were added to the emulsion after washing procedure.

Each of the emulsions 8-A to 8-E was chemically sensitized with sulfur, selenium and gold compounds at the optimum condition in the same manner as in preparation of the emulsion 7-A. Further, the emulsions were spectrally sensitized in the same manner as in preparation of the emulsion 7-A.

Coated samples were prepared in the same manner as in Example 3 using the emulsions. The samples were processed in the same manner as in Example 3. The photographic property was then evaluated. The results are set forth in Table 11. In Table 11, the concentration means the concentration of the compound in the solution.

TABLE 11

| | Compound | Concentration | Amount of solution | Sensitivity | Fog |
|---|---|---|---|---|---|
| 8-A | — | — | — | 100 | 0.14 |
| 8-B | — | — | — | 65 | 0.14 |
| 8-C | $LaCl_3.7H_2O$ | 1% | 90 cc | 140 | 0.15 |
| 8-D | $Ga(NO_3)_3.nH_2O$ | 1.22% | 50 cc | 155 | 0.14 |
| 8-E | $In_2(SO_4)_3.nH_2O$ | 0.93% | 30 cc | 175 | 0.14 |

I claim:

1. A silver halide photographic material which comprises a support and a light-sensitive layer provided thereon, said light-sensitive layer containing silver halide grains dispersed in gelatin, wherein a hexa-coordinated cyano-complex is doped in the silver halide grains under conditions that the amount of the complex is in the range of $1\times10^{-7}$ to $5\times10^{-3}$ mol based on 1 mol of silver halide and a localized phase of the complex is present in the surface of the grains, said localized phase containing the complex in an amount of $1\times10^{-5}$ to $1\times10^{-1}$ mol based on 1 mol of silver halide, and said complex being a salt containing a hexa-coordinated transition metal complex anion represented by the formula (I):

$$[M(CN)_6]^{n-} \quad (I)$$

wherein M is a transition metal selected from those consisting of metals of the VA, VIA, VIIA and VIII groups of the fourth, fifth and sixth periods in the periodic table, and n is 3 or 4, and wherein a water soluble compound having a function of inhibiting a reaction of the cyano-complex with gelatin is added to the grains after the silver halide grains are doped.

2. The silver halide photographic material as claimed in claim 1, wherein the compound is used in an amount of $10^{-5}$ to 1 mol based on 1 mol of silver halide.

3. The silver halide photographic material as claimed in claim 1, wherein the inhibiting compound is a salt of rubidium, caesium, beryllium, magnesium, calcium, strontium, barium, copper, zinc, cadmium, mercury or lead.

4. The silver halide photographic material as claimed in claim 1, wherein the inhibiting compound is a salt of caesium, magnesium, calcium, barium, copper, zinc or lead.

5. The silver halide photographic material as claimed in claim 1, wherein the inhibiting compound is a salt of magnesium, calcium or zinc.

6. The silver halide photographic material as claimed in claim 1, wherein the inhibiting compound is a salt of zinc.

7. The silver halide photographic material as claimed in claim 1, wherein the inhibiting compound is a salt of aluminum, gallium, indium, thallium, lanthanum, cerium, praseodymium, neodymium, promethium, samarium, europium, gadolinium, terbium, dysprosium, holmium, erbium, thulium, ytterbium or lutetium.

8. The silver halide photographic material as claimed in claim 1, wherein the inhibiting compound is a salt of gallium, indium, lanthanum, cerium, praseodymium, neodymium, promethium, samarium, europium or gadolinium.

9. The silver halide photographic material as claimed in claim 1, wherein at least 50% of the silver halide grains have ten or more dislocation lines in each of the grains.

10. The silver halide photographic material as claimed in claim 1, wherein the silver halide grains are doped at a pH of not lower than 7.

11. The silver halide photographic material as claimed in claim 1, wherein the silver halide grains are sensitized with a gold sensitizer after doping.

12. The silver halide photographic material as claimed in claim 1, wherein the amount of the localized phase is not more than 30% of each of the grains.

13. The silver halide photographic material as claimed in claim 1, wherein M in the formula (I) is iron, cobalt, ruthenium, rhenium, rhodium, osmium or iridium.

14. The silver halide photographic material as claimed in claim 1, wherein the hexa-coordinated cyano-complex is a salt of ammonium or an alkali metal with a hexa-coordinated transition metal complex anion represented by the formula (I).

15. A silver halide photographic material which comprises a support and a light-sensitive layer provided thereon, said light-sensitive layer containing silver halide grains dispersed in gelatin, wherein a hexa-coordinated cyano-complex is doped in the silver halide grains under conditions that the amount of the complex is in the range of $1\times10^{-7}$ to $5\times10^{-3}$ mol based on 1 mol of silver halide and a localized phase of the complex is present in the surface of the grains, said localized phase containing the complex in an amount of $1\times10^{-5}$ to $1\times10^{-1}$ mol based on 1 mol of silver halide, and said complex being a salt containing a hexa-coordinated transition metal complex anion represented by the formula (I):

$$[M(CN)_6]^{n-} \quad (I)$$

wherein M is a transition metal selected from those consisting of metals of the VA, VIA, VIIA and VIII groups of the fourth, fifth and sixth periods in the periodic table, and n is 3 or 4, and wherein the silver halide grains are doped in the presence of a water soluble compound having a function of inhibiting a reaction of the cyano-complex with gelatin, said compound being used in an amount of $4\times10^{-3}$ to 1 mol based on 1 mol of silver halide.

16. The silver halide photographic material as claimed in claim 15, wherein the inhibiting compound is a salt of rubidium, caesium, beryllium, magnesium, calcium, strontium, barium, copper, zinc, cadmium, mercury or lead.

17. The silver halide photographic material as claimed in claim 15, wherein the inhibiting compound is a salt of caesium, magnesium, calcium, barium, copper, zinc or lead.

18. The silver halide photographic material as claimed in claim 15, wherein the inhibiting compound is a salt of magnesium, calcium or zinc.

19. The silver halide photographic material as claimed in claim 15, wherein the inhibiting compound is a salt of zinc.

20. The silver halide photographic material as claimed in claim 15, wherein the inhibiting compound is a salt of aluminum, gallium, indium, thallium, lanthanum, cerium, praseodymium, neodymium, promethium, samarium, europium, gadolinium, terbium, dysprosium, holmium, erbium, thulium, ytterbium or lutetium.

21. The silver halide photographic material as claimed in claim 15, wherein the inhibiting compound is a salt of gallium, indium, lanthanum, cerium, praseodymium, neodymium, promethium, samarium, europium or gadolinium.

22. The silver halide photographic material as claimed in claim 15, wherein at least 50% of the silver halide grains have ten or more dislocation lines in each of the grains.

23. The silver halide photographic material as claimed in claim 15, wherein the silver halide grains are doped at a pH of not lower than 7.

24. The silver halide photographic material as claimed in claim 15, wherein the silver halide grains are sensitized with a gold sensitizer after doping.

25. The silver halide photographic material as claimed in claim 15, wherein the amount of the localized phase is not more than 30% of each of the grains.

26. The silver halide photographic material as claimed in claim 15, wherein M in the formula (I) is iron, cobalt, ruthenium, rhenium, rhodium, osmium or iridium.

27. The silver halide photographic material as claimed in claim 15, wherein the hexa-coordinated cyano-complex is a salt of ammonium or an alkali metal with a hexa-coordinated transition metal complex anion represented by the formula (I).

* * * * *